US011506138B2

(12) United States Patent
Pachner et al.

(10) Patent No.: US 11,506,138 B2
(45) Date of Patent: Nov. 22, 2022

(54) ENGINE SYSTEM WITH INFERENTIAL SENSOR

(71) Applicant: Garrett Transportation I Inc., Torrance, CA (US)

(72) Inventors: Daniel Pachner, Prague (CZ); Dejan Kihas, Burnaby (CA); Lubomir Baramov, Prague (CZ)

(73) Assignee: Garrett Transportation I Inc., Torrance, CA (US)

( * ) Notice: Subject to any disclaimer, the term of this patent is extended or adjusted under 35 U.S.C. 154(b) by 137 days.

(21) Appl. No.: 16/566,013

(22) Filed: Sep. 10, 2019

(65) Prior Publication Data

US 2020/0003142 A1 Jan. 2, 2020

Related U.S. Application Data

(63) Continuation of application No. 15/011,445, filed on Jan. 29, 2016, now Pat. No. 10,415,492.

(51) Int. Cl.
*F02D 41/14* (2006.01)
*F02D 23/02* (2006.01)
(Continued)

(52) U.S. Cl.
CPC ..... *F02D 41/1462* (2013.01); *F02D 41/1401* (2013.01); *F02D 23/02* (2013.01);
(Continued)

(58) Field of Classification Search
CPC .. F02D 41/1462; F02D 41/1401; F02D 23/02; F02D 35/024; F02D 35/026;
(Continued)

(56) References Cited

U.S. PATENT DOCUMENTS 3,744,461 A 7/1973 Davis
4,005,578 A 2/1977 McInerney
(Continued)

FOREIGN PATENT DOCUMENTS

CN 102063561 5/2011
CN 102331350 1/2012
(Continued)

OTHER PUBLICATIONS

Extended European Search Report for EP Application No. 17151521.6, dated Oct. 23, 2017.
(Continued)

*Primary Examiner* — Joseph J Dallo
*Assistant Examiner* — Kurt Philip Liethen
(74) *Attorney, Agent, or Firm* — Seager, Tufte & Wickhem, LLP

(57) ABSTRACT

An engine system incorporating an engine, one or more sensors, and a controller. The controller may be connected to the one or more sensors and the engine. The one or more sensors may be configured to sense one or more parameters related to operation of the engine. The controller may incorporate an air-path state estimator configured to estimate one or more air-path state parameters in the engine based on values of one or more parameters sensed by the sensors. The controller may have an on-line and an off-line portion, where the on-line portion may incorporate the air-path state estimator and the off-line portion may configure and/or calibrate a model for the air-path state estimator.

16 Claims, 4 Drawing Sheets

(51) Int. Cl.

| | |
|---|---|
| ***F02D 35/02*** | (2006.01) |
| ***F02D 41/00*** | (2006.01) |
| ***F02D 41/18*** | (2006.01) |
| ***F02D 41/22*** | (2006.01) |
| ***F02D 41/24*** | (2006.01) |
| ***F02D 41/26*** | (2006.01) |

(52) U.S. Cl.

CPC ..... *F02D 35/024* (2013.01); *F02D 35/026* (2013.01); *F02D 41/0062* (2013.01); *F02D 41/145* (2013.01); *F02D 41/18* (2013.01); *F02D 41/22* (2013.01); *F02D 41/2432* (2013.01); *F02D 41/26* (2013.01); *F02D 41/266* (2013.01); *F02D 2041/143* (2013.01); *F02D 2041/1416* (2013.01); *F02D 2041/1436* (2013.01); *F02D 2041/228* (2013.01); *F02D 2200/0402* (2013.01); *F02D 2200/0408* (2013.01); *F02D 2200/0416* (2013.01); *F02D 2200/0616* (2013.01)

(58) Field of Classification Search

CPC .... F02D 41/0062; F02D 41/145; F02D 41/18; F02D 41/22; F02D 41/2432; F02D 41/26; F02D 41/266; F02D 2041/1416; F02D 2041/143; F02D 2041/1436; F02D 2041/228; F02D 2200/0402; F02D 2200/0408; F02D 2200/0416; F02D 2200/0616; F02D 41/1438; F02D 2041/1433

See application file for complete search history.

(56) References Cited

U.S. PATENT DOCUMENTS 4,055,158 A 10/1977 Marsee
4,206,606 A 6/1980 Yamada
4,252,098 A 2/1981 Tomczak et al.
4,359,991 A 11/1982 Stumpp et al.
4,383,441 A 5/1983 Willis et al.
4,426,982 A 1/1984 Lehner et al.
4,438,497 A 3/1984 Willis et al.
4,440,140 A 4/1984 Kawagoe et al.
4,456,883 A 6/1984 Bullis et al.
4,485,794 A 12/1984 Kimberley et al.
4,601,270 A 7/1986 Kimberley et al.
4,616,308 A 10/1986 Morshedi et al.
4,653,449 A 3/1987 Kamei et al.
4,671,235 A 6/1987 Hosaka
4,677,559 A 6/1987 Van Bruck
4,735,181 A 4/1988 Kaneko et al.
4,947,334 A 8/1990 Massey et al.
4,962,570 A 10/1990 Hosaka et al.
5,044,337 A 9/1991 Williams
5,076,237 A 12/1991 Hartman et al.
5,089,236 A 2/1992 Clerc
5,091,843 A * 2/1992 Peczkowski ..... G05B 13/048 700/44
5,094,213 A 3/1992 Dudek et al.
5,095,874 A 3/1992 Schnaibel et al.
5,108,716 A 4/1992 Nishizawa
5,123,397 A 6/1992 Richeson
5,150,289 A 9/1992 Badavas
5,186,081 A 2/1993 Richardson et al.
5,233,829 A 8/1993 Komatsu
5,270,935 A 12/1993 Dudek et al.
5,273,019 A 12/1993 Matthews et al.
5,282,449 A 2/1994 Takahashi et al.
5,293,553 A 3/1994 Dudek et al.
5,349,816 A 9/1994 Sanbayashi et al.
5,365,734 A 11/1994 Takeshima
5,394,322 A 2/1995 Hansen
5,394,331 A 2/1995 Dudek et al.
5,398,502 A 3/1995 Watanabe
5,408,406 A 4/1995 Mathur et al.
5,431,139 A 7/1995 Grutter et al.
5,452,576 A 9/1995 Hamburg et al.
5,477,840 A 12/1995 Neumann
5,560,208 A 10/1996 Halimi et al.
5,570,574 A 11/1996 Yamashita et al.
5,598,825 A 2/1997 Neumann
5,609,139 A 3/1997 Ueda et al.
5,611,198 A 3/1997 Lane et al.
5,682,317 A 10/1997 Keeler et al.
5,690,086 A 11/1997 Kawano et al.
5,692,478 A 12/1997 Nogi et al.
5,697,339 A 12/1997 Esposito
5,704,011 A 12/1997 Hansen et al.
5,740,033 A 4/1998 Wassick et al.
5,746,183 A 5/1998 Parke et al.
5,765,533 A 6/1998 Nakajima
5,771,867 A 6/1998 Amstutz et al.
5,785,030 A 7/1998 Paas
5,788,004 A 8/1998 Friedmann et al.
5,842,340 A 12/1998 Bush et al.
5,846,157 A 12/1998 Reinke et al.
5,893,092 A 4/1999 Driscoll
5,924,280 A 7/1999 Tarabulski
5,942,195 A 8/1999 Lecea et al.
5,964,199 A 10/1999 Atago et al.
5,970,075 A 10/1999 Wasada
5,974,788 A 11/1999 Hepburn et al.
5,995,895 A 11/1999 Watt et al.
6,029,626 A 2/2000 Bruestle
6,035,640 A 3/2000 Kolmanovsky et al.
6,048,620 A 4/2000 Zhong
6,048,628 A 4/2000 Hillmann et al.
6,055,810 A 5/2000 Borland et al.
6,056,781 A 5/2000 Wassick et al.
6,058,700 A 5/2000 Yamashita et al.
6,067,800 A 5/2000 Kolmanovsky et al.
6,076,353 A 6/2000 Fruedenberg et al.
6,105,365 A 8/2000 Deeba et al.
6,122,555 A 9/2000 Lu
6,134,883 A 10/2000 Kato et al.
6,153,159 A 11/2000 Engeler et al.
6,161,528 A 12/2000 Akao et al.
6,170,259 B1 1/2001 Boegner et al.
6,171,556 B1 1/2001 Burk et al.
6,178,743 B1 1/2001 Hirota et al.
6,178,749 B1 1/2001 Kolmanovsky et al.
6,192,311 B1 * 2/2001 Yasui ..... F02D 41/1403 701/113
6,208,914 B1 3/2001 Ward et al.
6,216,083 B1 4/2001 Ulyanov et al.
6,233,922 B1 5/2001 Maloney
6,236,956 B1 5/2001 Mantooth et al.
6,237,330 B1 5/2001 Takahashi et al.
6,242,873 B1 6/2001 Drozdz et al.
6,256,575 B1 7/2001 Sans
6,263,672 B1 7/2001 Roby et al.
6,273,060 B1 8/2001 Cullen
6,279,551 B1 8/2001 Iwano et al.
6,312,538 B1 11/2001 Latypov et al.
6,314,724 B1 11/2001 Kakuyama et al.
6,321,538 B2 11/2001 Hasler
6,327,361 B1 12/2001 Harshavardhana et al.
6,338,245 B1 1/2002 Shimoda et al.
6,341,487 B1 1/2002 Takahashi et al.
6,347,619 B1 2/2002 Whiting et al.
6,360,159 B1 3/2002 Miller et al.
6,360,541 B2 3/2002 Waszkiewicz et al.
6,360,732 B1 3/2002 Bailey et al.
6,363,715 B1 4/2002 Bidner et al.
6,363,907 B1 4/2002 Arai et al.
6,379,281 B1 4/2002 Collins et al.
6,389,203 B1 5/2002 Jordan et al.
6,389,803 B1 5/2002 Sumilla et al.
6,425,371 B2 7/2002 Majima
6,427,436 B1 8/2002 Allansson et al.
6,431,160 B1 8/2002 Sugiyama et al.
6,445,963 B1 9/2002 Blevins et al.

(56) References Cited

U.S. PATENT DOCUMENTS 6,446,430 B1 9/2002 Roth et al.
6,453,308 B1 9/2002 Zhao et al.
6,463,733 B1 10/2002 Asik et al.
6,463,734 B1 10/2002 Tamura et al.
6,466,893 B1 10/2002 Latwesen et al.
6,470,682 B2 10/2002 Gray, Jr.
6,470,862 B2 10/2002 Isobe et al.
6,470,886 B1 10/2002 Jestrabek-Hart
6,481,139 B2 11/2002 Weldle
6,494,038 B2 12/2002 Kobayashi et al.
6,502,391 B1 1/2003 Hirota et al.
6,510,351 B1 1/2003 Blevins et al.
6,512,974 B2 1/2003 Houston et al.
6,513,495 B1 2/2003 Franke et al.
6,532,433 B2 3/2003 Bharadwaj et al.
6,546,329 B2 4/2003 Bellinger
6,550,307 B1 4/2003 Zhang et al.
6,553,754 B2 4/2003 Meyer et al.
6,560,528 B1 5/2003 Gitlin et al.
6,560,960 B2 5/2003 Nishimura et al.
6,571,191 B1 5/2003 York et al.
6,579,206 B2 6/2003 Liu et al.
6,591,605 B2 7/2003 Lewis
6,594,990 B2 7/2003 Kuenstler et al.
6,601,387 B2 8/2003 Zurawski et al.
6,612,293 B2 9/2003 Schweinzer et al.
6,615,584 B2 9/2003 Ostertag
6,625,978 B1 9/2003 Eriksson et al.
6,629,408 B1 10/2003 Murakami et al.
6,637,382 B1 10/2003 Brehob et al.
6,644,017 B2 11/2003 Takahashi et al.
6,647,710 B2 11/2003 Nishiyama et al.
6,647,971 B2 11/2003 Vaughan et al.
6,651,614 B2 11/2003 Flamig-Vetter et al.
6,662,058 B1 12/2003 Sanchez
6,666,198 B2 12/2003 Mitsutani
6,666,410 B2 12/2003 Boelitz et al.
6,671,603 B2 12/2003 Cari et al.
6,672,052 B2 1/2004 Taga et al.
6,672,060 B1 1/2004 Buckland et al.
6,679,050 B1 1/2004 Takahashi et al.
6,687,597 B2 2/2004 Sulatisky et al.
6,688,283 B2 2/2004 Jaye
6,694,244 B2 2/2004 Meyer et al.
6,694,724 B2 2/2004 Tanaka et al.
6,705,084 B2 3/2004 Allen et al.
6,718,254 B2 4/2004 Hashimoto et al.
6,718,753 B2 4/2004 Bromberg et al.
6,725,208 B1 4/2004 Hartman et al.
6,736,120 B2 5/2004 Surnilla
6,738,682 B1 5/2004 Pasadyn
6,739,122 B2 5/2004 Kitajima et al.
6,742,330 B2 6/2004 Genderen
6,743,352 B2 6/2004 Ando et al.
6,748,936 B2 6/2004 Kinomura et al.
6,752,131 B2 6/2004 Poola et al.
6,752,135 B2 6/2004 McLaughlin et al.
6,757,579 B1 6/2004 Pasadyn
6,758,037 B2 7/2004 Terada et al.
6,760,631 B1 7/2004 Berkowitz et al.
6,760,657 B2 7/2004 Katoh
6,760,658 B2 7/2004 Yasui et al.
6,770,009 B2 8/2004 Badillo et al.
6,772,585 B2 8/2004 Iihoshi et al.
6,775,623 B2 8/2004 Ali et al.
6,779,344 B2 8/2004 Hartman et al.
6,779,512 B2 8/2004 Mitsutani
6,788,072 B2 9/2004 Nagy et al.
6,789,533 B1 9/2004 Hashimoto et al.
6,792,927 B2 9/2004 Kobayashi
6,804,618 B2 10/2004 Junk
6,814,062 B2 11/2004 Esteghlal et al.
6,817,171 B2 11/2004 Zhu
6,823,667 B2 11/2004 Braun et al.
6,823,675 B2 11/2004 Brunell et al.
6,826,903 B2 12/2004 Yahata et al.
6,827,060 B2 12/2004 Huh
6,827,061 B2 12/2004 Nytomt et al.
6,827,070 B2 12/2004 Fehl et al.
6,834,497 B2 12/2004 Miyoshi et al.
6,839,637 B2 1/2005 Moteki et al.
6,849,030 B2 2/2005 Yamamoto et al.
6,873,675 B2 3/2005 Kurady et al.
6,874,467 B2 4/2005 Hunt et al.
6,879,906 B2 4/2005 Makki et al.
6,882,929 B2 4/2005 Liang et al.
6,904,751 B2 6/2005 Makki et al.
6,911,414 B2 6/2005 Kimura et al.
6,915,779 B2 7/2005 Sriprakash
6,920,865 B2 7/2005 Lyon
6,923,902 B2 8/2005 Ando et al.
6,925,372 B2 8/2005 Yasui
6,925,796 B2 8/2005 Nieuwstadt et al.
6,928,362 B2 8/2005 Meaney
6,928,817 B2 8/2005 Ahmad
6,931,840 B2 8/2005 Strayer et al.
6,934,931 B2 8/2005 Plumer et al.
6,941,744 B2 9/2005 Tanaka
6,945,033 B2 9/2005 Sealy et al.
6,948,310 B2 9/2005 Roberts, Jr. et al.
6,953,024 B2 10/2005 Linna et al.
6,965,826 B2 11/2005 Andres et al.
6,968,677 B2 11/2005 Tamura
6,971,258 B2 12/2005 Rhodes et al.
6,973,382 B2 12/2005 Rodriguez et al.
6,978,744 B2 12/2005 Yuasa et al.
6,988,017 B2 1/2006 Pasadyn et al.
6,996,975 B2 2/2006 Radhamohan et al.
7,000,379 B2 2/2006 Makki et al.
7,013,637 B2 3/2006 Yoshida
7,016,779 B2 3/2006 Bowyer
7,028,464 B2 4/2006 Rosel et al.
7,039,475 B2 5/2006 Sayyarrodsari et al.
7,047,938 B2 5/2006 Flynn et al.
7,052,434 B2 5/2006 Makino et al.
7,055,311 B2 6/2006 Beutel et al.
7,059,112 B2 6/2006 Bidner et al.
7,063,080 B2 6/2006 Kita et al.
7,067,319 B2 6/2006 Wills et al.
7,069,903 B2 7/2006 Surnilla et al.
7,082,753 B2 8/2006 Dalla Betta et al.
7,085,615 B2 8/2006 Persson et al.
7,106,866 B2 9/2006 Astorino et al.
7,107,978 B2 9/2006 Itoyama
7,111,450 B2 9/2006 Surnilla
7,111,455 B2 9/2006 Okugawa et al.
7,113,835 B2 9/2006 Boyden et al.
7,117,046 B2 10/2006 Boyden et al.
7,117,078 B1 * 10/2006 Gangopadhyay ..... F02D 41/182 123/672
7,124,013 B2 10/2006 Yasui
7,149,590 B2 12/2006 Martin et al.
7,151,976 B2 12/2006 Lin
7,152,023 B2 12/2006 Das
7,155,334 B1 12/2006 Stewart et al.
7,165,393 B2 1/2007 Betta et al.
7,165,399 B2 1/2007 Stewart
7,168,239 B2 1/2007 Ingram et al.
7,182,075 B2 2/2007 Shahed et al.
7,184,845 B2 2/2007 Sayyarrodsari et al.
7,184,992 B1 2/2007 Polyak et al.
7,188,637 B2 3/2007 Dreyer et al.
7,194,987 B2 3/2007 Mogi
7,197,485 B2 3/2007 Fuller
7,200,988 B2 4/2007 Yamashita
7,204,079 B2 4/2007 Audoin
7,212,908 B2 5/2007 Li et al.
7,275,374 B2 10/2007 Stewart et al.
7,275,415 B2 10/2007 Rhodes et al.
7,281,368 B2 10/2007 Miyake et al.
7,292,926 B2 11/2007 Schmidt et al.
7,302,937 B2 12/2007 Ma et al.
7,321,834 B2 1/2008 Chu et al.
7,323,036 B2 1/2008 Boyden et al.

(56) References Cited

U.S. PATENT DOCUMENTS 7,328,577 B2 2/2008 Stewart et al.
7,337,022 B2 2/2008 Wojsznis et al.
7,349,776 B2 3/2008 Spillane et al.
7,357,125 B2 4/2008 Kolavennu
7,375,374 B2 5/2008 Chen et al.
7,376,471 B2 5/2008 Das et al.
7,380,547 B1 6/2008 Ruiz
7,383,118 B2 6/2008 Imai et al.
7,389,773 B2 6/2008 Stewart et al.
7,392,129 B2 6/2008 Hill et al.
7,398,082 B2 7/2008 Schwinke et al.
7,398,149 B2 7/2008 Ueno et al.
7,400,967 B2 7/2008 Ueno et al.
7,413,583 B2 8/2008 Langer et al.
7,415,389 B2 8/2008 Stewart et al.
7,418,372 B2 8/2008 Nishira et al.
7,430,854 B2 10/2008 Yasui et al.
7,433,743 B2 10/2008 Pistikopoulos et al.
7,444,191 B2 10/2008 Caldwell et al.
7,444,193 B2 10/2008 Cutler
7,447,554 B2 11/2008 Cutler
7,467,614 B2 12/2008 Stewart et al.
7,469,177 B2 12/2008 Samad et al.
7,474,953 B2 1/2009 Hulser et al.
7,493,236 B1 2/2009 Mock et al.
7,515,975 B2 4/2009 Stewart
7,522,963 B2 4/2009 Boyden et al.
7,536,232 B2 5/2009 Boyden et al.
7,542,842 B2 6/2009 Hill et al.
7,577,483 B2 8/2009 Fan et al.
7,587,253 B2 9/2009 Rawlings et al.
7,591,135 B2 9/2009 Stewart
7,599,749 B2 10/2009 Sayyarrodsari et al.
7,599,750 B2 10/2009 Piche
7,603,226 B2 10/2009 Henein
7,627,843 B2 12/2009 Dozorets et al.
7,630,868 B2 12/2009 Turner et al.
7,634,323 B2 12/2009 Vermillion et al.
7,634,417 B2 12/2009 Boyden et al.
7,650,780 B2 1/2010 Hall
7,668,704 B2 2/2010 Perchanok et al.
7,676,318 B2 3/2010 Allain
7,698,004 B2 4/2010 Boyden et al.
7,702,519 B2 4/2010 Boyden et al.
7,725,199 B2 5/2010 Brackney
7,743,606 B2 6/2010 Havlena et al.
7,748,217 B2 7/2010 Muller
7,752,840 B2 7/2010 Stewart
7,765,792 B2 8/2010 Rhodes et al.
7,779,680 B2 8/2010 Sasaki et al.
7,793,489 B2 9/2010 Wang et al.
7,798,938 B2 9/2010 Matsubara et al.
7,826,909 B2 11/2010 Attarwala
7,831,318 B2 11/2010 Bartee et al.
7,840,287 B2 11/2010 Wojsznis et al.
7,844,351 B2 11/2010 Piche
7,844,352 B2 11/2010 Youzis et al.
7,846,299 B2 12/2010 Backstrom et al.
7,850,104 B2 12/2010 Havlena et al.
7,856,966 B2 12/2010 Saitoh
7,860,586 B2 12/2010 Boyden et al.
7,861,518 B2 1/2011 Federle
7,862,771 B2 1/2011 Boyden et al.
7,877,239 B2 1/2011 Grichnik et al.
7,878,178 B2 2/2011 Stewart et al.
7,891,669 B2 2/2011 Araujo et al.
7,904,280 B2 3/2011 Wood
7,905,103 B2 3/2011 Larsen et al.
7,907,769 B2 3/2011 Sammak et al.
7,930,044 B2 4/2011 Attarwala
7,933,849 B2 4/2011 Bartee et al.
7,958,730 B2 6/2011 Stewart
7,987,145 B2 7/2011 Baramov
7,996,140 B2 8/2011 Stewart et al.
8,001,767 B2 8/2011 Kakuya et al.
8,019,911 B2 9/2011 Dressier et al.
8,025,167 B2 9/2011 Schneider et al.
8,032,235 B2 10/2011 Sayyar-Rodsari
8,046,089 B2 10/2011 Renfro et al.
8,060,290 B2 11/2011 Stewart et al.
8,078,291 B2 12/2011 Pekar et al.
8,109,255 B2 2/2012 Stewart et al.
8,121,818 B2 2/2012 Gorinevsky
8,145,329 B2 3/2012 Pekar et al.
8,209,963 B2 7/2012 Kesse et al.
8,229,163 B2 7/2012 Coleman et al.
8,265,854 B2 9/2012 Stewart et al.
8,281,572 B2 10/2012 Chi et al.
8,311,653 B2 11/2012 Zhan et al.
8,312,860 B2 11/2012 Yun et al.
8,321,172 B2 * 11/2012 Wagner ..... F02D 41/18 702/147
8,360,040 B2 1/2013 Stewart et al.
8,379,267 B2 2/2013 Mestha et al.
8,396,644 B2 3/2013 Kabashima et al.
8,453,431 B2 6/2013 Wang et al.
8,473,079 B2 6/2013 Havlena
8,478,506 B2 7/2013 Grichnik et al.
RE44,452 E 8/2013 Stewart et al.
8,504,175 B2 8/2013 Pekar et al.
8,505,278 B2 8/2013 Farrell et al.
8,543,170 B2 9/2013 Mazzara, Jr. et al.
8,543,362 B2 9/2013 Germann et al.
8,555,613 B2 10/2013 Wang et al.
8,596,045 B2 12/2013 Tuomivaara et al.
8,620,461 B2 12/2013 Kihas
8,649,884 B2 2/2014 MacArthur et al.
8,649,961 B2 2/2014 Hawkins et al.
8,694,197 B2 4/2014 Rajagopalan et al.
8,700,291 B2 4/2014 Herrmann
8,751,241 B2 6/2014 Oesterling et al.
8,762,026 B2 6/2014 Wolfe et al.
8,763,377 B2 7/2014 Yacoub
8,813,690 B2 8/2014 Kumar et al.
8,892,221 B2 11/2014 Kram et al.
8,899,018 B2 12/2014 Frazier et al.
8,904,760 B2 12/2014 Mital
9,170,573 B2 10/2015 Kihas
9,223,301 B2 12/2015 Stewart et al.
9,253,200 B2 2/2016 Schwarz et al.
2002/0112469 A1 * 8/2002 Kanazawa ..... F01N 3/0814 60/285
2002/0116104 A1 8/2002 Kawashima et al.
2003/0089102 A1 5/2003 Colignon et al.
2003/0150961 A1 8/2003 Boelitz et al.
2004/0006973 A1 1/2004 Makki et al.
2004/0034460 A1 2/2004 Folkerts et al.
2004/0086185 A1 5/2004 Sun
2004/0117766 A1 6/2004 Mehta et al.
2004/0118107 A1 6/2004 Ament
2004/0144082 A1 7/2004 Mianzo et al.
2004/0165781 A1 8/2004 Sun
2004/0199481 A1 10/2004 Hartman et al.
2004/0221889 A1 11/2004 Dreyer et al.
2004/0226287 A1 11/2004 Edgar et al.
2005/0209714 A1 2/2005 Rawlings et al.
2005/0107895 A1 5/2005 Pistikopoulos et al.
2005/0143952 A1 6/2005 Tomoyasu et al.
2005/0171667 A1 8/2005 Morita
2005/0187643 A1 8/2005 Sayyar-Rodsari et al.
2005/0193739 A1 9/2005 Brunell et al.
2005/0210868 A1 9/2005 Funabashi
2005/0211233 A1 9/2005 Moulin et al.
2005/0216179 A1 * 9/2005 Yasui ..... F02D 41/2416 701/115
2006/0047607 A1 3/2006 Boyden et al.
2006/0111881 A1 5/2006 Jackson
2006/0137347 A1 6/2006 Stewart et al.
2006/0168945 A1 8/2006 Samad et al.
2006/0212140 A1 9/2006 Brackney
2006/0265203 A1 11/2006 Jenny et al.
2006/0271270 A1 11/2006 Chauvin et al.
2006/0282178 A1 12/2006 Das et al.
2007/0101977 A1 5/2007 Stewart

(56) References Cited

U.S. PATENT DOCUMENTS

2007/0142936 A1 6/2007 Denison et al.
2007/0144149 A1 6/2007 Kolavennu et al.
2007/0156259 A1 7/2007 Baramov et al.
2007/0275471 A1 11/2007 Coward
2008/0010973 A1* 1/2008 Gimbres ..... F02D 41/1462 60/276
2008/0071395 A1 3/2008 Pachner
2008/0097625 A1 4/2008 Vouzis et al.
2008/0103747 A1 5/2008 Macharia et al.
2008/0103748 A1 5/2008 Axelrud et al.
2008/0104003 A1 5/2008 Macharia et al.
2008/0109100 A1 5/2008 Macharia et al.
2008/0125875 A1 5/2008 Stewart et al.
2008/0132178 A1 6/2008 Chatterjee et al.
2008/0183311 A1 7/2008 MacArthur et al.
2008/0208778 A1 8/2008 Sayyar-Rodsari et al.
2008/0244449 A1 10/2008 Morrison et al.
2008/0264036 A1 10/2008 Bellovary
2009/0005889 A1 1/2009 Sayyar-Rodsari
2009/0008351 A1 1/2009 Schneider et al.
2009/0043546 A1 2/2009 Srinivasan et al.
2009/0087029 A1 4/2009 Coleman et al.
2009/0131216 A1 5/2009 Matsubara et al.
2009/0182518 A1 7/2009 Chu et al.
2009/0198350 A1 8/2009 Thiele
2009/0204233 A1 8/2009 Zhan et al.
2009/0240480 A1 9/2009 Baramov
2009/0254202 A1 10/2009 Pekar et al.
2009/0287320 A1 11/2009 MacGregor et al.
2009/0312998 A1 12/2009 Berckmans et al.
2010/0017094 A1 1/2010 Stewart et al.
2010/0038158 A1 2/2010 Whitney et al.
2010/0050607 A1 3/2010 He et al.
2010/0122523 A1 5/2010 Vosz
2010/0126481 A1* 5/2010 Willi ..... F02D 41/1462 123/672
2010/0204808 A1 8/2010 Thiele
2010/0268353 A1 10/2010 Crisalle et al.
2010/0300069 A1* 12/2010 Herrmann ..... F02D 41/1461 60/289
2010/0300070 A1 12/2010 He et al.
2010/0305719 A1 12/2010 Pekar et al.
2010/0327090 A1 12/2010 Havlena et al.
2011/0006025 A1 1/2011 Schneider et al.
2011/0010073 A1 1/2011 Stewart et al.
2011/0029235 A1 2/2011 Berry
2011/0046752 A1 2/2011 Piche
2011/0056265 A1 3/2011 Yacoub
2011/0060424 A1 3/2011 Havlena
2011/0066308 A1 3/2011 Yang et al.
2011/0071653 A1 3/2011 Kihas
2011/0087420 A1 4/2011 Stewart et al.
2011/0104015 A1 5/2011 Boyden et al.
2011/0125293 A1 5/2011 Havlena
2011/0125295 A1 5/2011 Bednasch et al.
2011/0131017 A1 6/2011 Cheng et al.
2011/0167025 A1 7/2011 Danai et al.
2011/0257789 A1 10/2011 Stewart et al.
2011/0264353 A1 10/2011 Atkinson et al.
2011/0270505 A1 11/2011 Chaturvedi et al.
2011/0301723 A1 12/2011 Pekar et al.
2011/0313958 A1* 12/2011 Roverso ..... G01W 1/00 706/12
2012/0024089 A1 2/2012 Couey et al.
2012/0109620 A1 5/2012 Gaikwad et al.
2012/0197504 A1* 8/2012 Sujan ..... G01C 21/3469 701/70
2013/0024089 A1 1/2013 Wang et al.
2013/0030554 A1 1/2013 Macarthur et al.
2013/0054113 A1* 2/2013 Loeffler ..... F02D 41/14 701/103
2013/0067894 A1 3/2013 Stewart et al.
2013/0111878 A1 5/2013 Pachner et al.
2013/0111905 A1 5/2013 Pekar et al.
2013/0131954 A1 5/2013 Yu et al.
2013/0131956 A1 5/2013 Thibault et al.
2013/0131967 A1 5/2013 Yu et al.
2013/0158834 A1* 6/2013 Wagner ..... F02D 41/145 701/102
2013/0204403 A1 8/2013 Zheng et al.
2013/0338900 A1 12/2013 Ardanese et al.
2014/0032189 A1 1/2014 Hehle et al.
2014/0034460 A1 2/2014 Chou
2014/0318216 A1 10/2014 Singh
2014/0343713 A1 11/2014 Ziegler et al.
2014/0358254 A1 12/2014 Chu et al.
2015/0121071 A1 4/2015 Schwarz et al.
2015/0354877 A1 12/2015 Burns et al.
2016/0003180 A1* 1/2016 McNulty ..... F02D 41/222 701/102
2016/0328500 A1 11/2016 Pachner
2017/0234245 A1* 8/2017 Bruner ..... F02D 35/027 123/525

FOREIGN PATENT DOCUMENTS

DE 19628796 10/1997
DE 10219832 11/2002
DE 102009016509 10/2010
DE 102011103346 A1 8/2012
EP 0301527 2/1989
EP 0950803 4/1999
EP 0877309 6/2000
EP 1134368 3/2001
EP 1180583 2/2002
EP 1221544 7/2002
EP 1225490 7/2002
EP 1245811 10/2002
EP 1273337 1/2003
EP 1420153 A2 5/2004
EP 1447727 A2 8/2004
EP 1498791 A1 1/2005
EP 1425642 11/2005
EP 1686251 8/2006
EP 1399784 10/2007
EP 2107439 10/2009
EP 2146258 1/2010
EP 1794339 7/2011
EP 1529941 11/2011
EP 2543845 A1 1/2013
EP 2551480 A1 1/2013
EP 2589779 A2 5/2013
EP 2617975 7/2013
EP 2267559 1/2014
EP 2919079 9/2015
JP 59190443 10/1984
JP 2010282618 12/2010
WO 0144629 A2 6/2001
WO WO 02/32552 4/2002
WO WO 02/097540 12/2002
WO WO 02/101208 12/2002
WO WO 03/023538 3/2003
WO WO 2003/048533 6/2003
WO WO 03/065135 8/2003
WO WO 03/078816 9/2003
WO WO 2004/02723 0 4/2004
WO WO 2006/021437 3/2006
WO WO 2007/078907 7/2007
WO WO 2008/033800 3/2008
WO WO 2008/115911 9/2008
WO WO 2012/076838 6/2012
WO WO 2013/119665 8/2013
WO WO 2014/165439 10/2014
WO WO 2016/053194 4/2016

OTHER PUBLICATIONS

European Search Report for EP Application No. 12191156.4-1603 dated Feb. 9, 2015.
European Search Report for EP Application No. EP 10175270.7-2302419 dated Jan. 16, 2013.

(56) References Cited

OTHER PUBLICATIONS

European Search Report for EP Application No. EP 15152957.5-1807 dated Feb. 10, 2015.
U.S. Appl. No. 15/005,406, filed Jan. 25, 2016.
Khair et al., "Emission Formation in Diesel Engines," Downloaded from https://www.dieselnet.com/tech/diesel_emiform.php, 33 pages, printed Oct. 14, 2016.
Kihas et al., "Chapter 14, Diesel Engine SCR Systems: Modeling Measurements and Control," Catalytic Reduction Technology (book), Part 1, Chapter 14, prior to Jan. 29, 2016.
Krause et al., "Effect of Inlet Air Humidity and Temperature on Diesel Exhaust Emissions," SAE International Automotive Engineering Congress, 8 pages, Jan. 8-12, 1973.
Lavoie et al., "Experimental and Theoretical Study of Nitric Oxide Formation in Internal Combustion Engines," Combustion Science and Technology, vol. 1, pp. 313-326, 1970.
Manchur et al., "Time Resolution Effects on Accuracy of Real-Time NOx Emissions Measurements," SAE Technical Paper Series 2005-01-0674, 2005 SAE World Congress, 19 pages, Apr. 11-14, 2005.
Mohammadpour et al., "A Survey on Diagnostics Methods for Automotive Engines," 2011 American Control Conference, pp. 985-990, Jun. 29-Jul. 1, 2011.
Moos, "Catalysts as Sensors—A Promising Novel Approach in Automotive Exhaust Gas Aftertreatment," http://www.mdpi.com/1424-8220/10/7/6773htm, 10 pages, Jul. 13, 2010.
Olsen, "Analysis and Simulation of the Rate of Heat Release (ROHR) in Diesel Engines," MSc-Assignment, 105 pages, Jun. 2013.
Patrinos et al., "A Global Piecewise Smooth Newton Method for Fast Large-Scale Model Predictive Control," Tech Report TR2010-02, National Technical University of Athens, 23 pages, 2010.
Payri et al., "Diesel NOx Modeling with a Reduction Mechanism for the Initial NOx Coming from EGR or Re-Entrained Burned Gases," 2008 World Congress, SAE Technical Paper Series 2008-01-1188, 13 pages, Apr. 14-17, 2008.
Payri et al., "Methodology for Design and Calibration of a Drift Compensation Method for Fuel-to-Air Ratio," SAE International 2012-01-0717, 13 pages, Apr. 16, 2012.
Pipho et al., "NO2 Formation in a Diesel Engine," SAE Technical Paper Series 910231, International Congress and Exposition, 15 pages, Feb. 25-Mar. 1, 1991.
Querel et al., "Control of an SCR System Using a Virtual NOx Sensor," 7th IFAC Symposium on Advances in Automotive Control, The International Federation of Automotive Control, pp. 9-14, Sep. 4-7, 2013.
Ricardo Software, "Powertrain Design at Your Fingertips," retrieved from http://www.ricardo.com/PageFiles/864/WaveFlyerA4_4PP.pdf, 2 pages, downloaded Jul. 27, 2015.
Santin et al., "Combined Gradient/Newton Projection Semi-Explicit QP Solver for Problems with Bound Constraints," 2 pages, prior to Jan. 29, 2016.
Schilling et al., "A Real-Time Model for the Prediction of the NOx Emissions in DI Diesel Engines," Proceedings of the 2006 IEEE International Conference on Control Applications, pp. 2042-2047, Oct. 4-7, 2006.
Schilling, "Model-Based Detection and Isolation of Faults in the Air and Fuel Paths of Common-Rail DI Diesel Engines Equipped with a Lambda and a Nitrogen Oxides Sensor," Doctor of Sciences Dissertation, 210 pages, 2008.
Shahzad et al., "Preconditioners for Inexact Interior Point Methods for Predictive Control," 2010 American Control Conference, pp. 5714-5719, Jun. 30-Jul. 2010.
Signer et al., "European Programme on Emissions, Fuels and Engine Technologies (EPEFE)—Heavy Duty Diesel Study," International Spring Fuels and Lubricants Meeting, SAE 961074, May 6-8, 1996.
Smith, "Demonstration of a Fast Response On-Board NOx Sensor for Heavy-Duty Diesel Vehicles," Technical report, Southwest Research Institute Engine and Vehicle Research Division SwRI Project No. 03-02256 Contract No. 98-302, 2000. Unable to Obtain a Copy of This Reference.
Stradling et al., "The Influene of Fuel Properties and Injection Timing on the Exhaust Emissions and Fuel Consumption of an Iveco Heavy-Duty Diesel Engine," International Spring Fuels and Lubricants Meeting, SAE 971635, May 5-8, 1997.
Traver et al., "A Neural Network-Based Virtual NOx Sensor for Diesel Engines," 7 pages, prior to Jan. 29, 2016.
Tschanz et al., "Cascaded Multivariable Control of the Combustion in Diesel Engines," The International Federation of Automatic Control (IFAC), 2012 Workshop on Engine and Powertrain Control, Simulation and Modeling, pp. 25-32, Oct. 23-25, 2012.
Tschanz et al., "Control of Diesel Engines Using NOx-Emission Feedback," International Journal of Engine Research, vol. 14, No. 1, pp. 45-56, 2013.
Tschanz et al., "Feedback Control of Particulate Matter and Nitrogen Oxide Emissions in Diesel Engines," Control Engineering Practice, vol. 21, pp. 1809-1820, 2013.
Turner, "Automotive Sensors, Sensor Technology Series," Momentum Press, Unable to Obtain the Entire Book, a Copy of the Front and Back Covers and Table of Contents are Provided, 2009.
Van Heiden et al., "Optimization of Urea SCR deNOx Systems for HD Diesel Engines," SAE International 2004-01-0154, 13 pages, 2004.
VDO, "UniNOx-Sensor Specification," Continental Trading GmbH, 2 pages, Aug. 2007.
Vereschaga et al., "Piecewise Affine Modeling of NOx Emission Produced by a Diesel Engine," 2013 European Control Conference (ECC), pp. 2000-2005, Jul. 17-19, 2013.
Wahlstrom et al., "Modelling Diesel Engines with a Variable-Geometry Turbocharger and Exhaust Gas Recirculation by Optimization of Model Parameters for Capturing Non-Linear System Dynamics," (Original Publication) Proceedings of the Institution of Mechanical Engineers, Part D, Journal of Automobile Engineering, vol. 225, No. 7, 28 pages, 2011.
Wang et al., "Sensing Exhaust NO2 Emissions Using the Mixed Potential Principal," SAE 2014-01-1487, 7 pages, Apr. 1, 2014.
Wilhelmsson et al., "A Fast Physical NOx Model Implemented on an Embedded System," Proceedings of the IFAC Workshop on Engine and Powertrain Control, Simulation and Modeling, pp. 207-215, Nov. 30-Dec. 2, 2009.
Wilhemsson et al., "A Physical Two-Zone NOx Model Intended for Embedded Implementation," SAE 2009-01-1509, 11 pages, 2009.
Winkler et al., "Incorporating Physical Knowledge About the Formation of Nitric Oxides into Evolutionary System dentification," Proceedings of the 20th European Modeling and Simulation Symposium (EMSS), 6 pages, 2008.
Winkler et al., "On-Line Modeling Based On Genetic Programming," 12 pages, International Journal on Intelligent Systems Technologies and Applications 2, 2007.
Winkler et al., "Using Genetic Programming in Nonlinear Model Identification," 99 pages, prior to Jan. 29, 2016.
Winkler et al., "Virtual Sensors for Emissions of a Diesel Engine Produced by Evolutionary System Identification," LNCS, vol. 5717, 8 pages, 2009.
Winkler, "Evolutionary System Identification—Modem Approaches and Practical Applications," Kepler Universitat Linz, Reihe C: Technik und Naturwissenschaften, Universitatsverlag Rudolf Trauner, 2009. Unable to Obtain a Copy of This Reference.
Wong, "CARB Heavy-Duty OBD Update," California Air Resources Board, SAE OBD TOPTEC, Downloaded from http://www.arb.ca.gov/msprog/obdprog/hdobdreg.htm, 72 pages, Sep. 15, 2005.
Yao et al., "The Use of Tunnel Concentration Profile Data to Determine the Ratio of NO2/NOx Directly Emitted from Vehicles," HAL Archives, 19 pages, 2005.
Zaman, "Lincoln Motor Company: Case study 2015 Lincoln MKC," Automotive Electronic Design Fundamentals, Chapter 6, 2015.
Zeldovich, "The Oxidation of Nitrogen in Combustion and Explosions," ACTA Physiochimica U.R.S.S., vol. XX1, No. 4, 53 pages, 1946.
Zhuiykov et al., "Development of Zirconia-Based Potentiometric NOx Sensors for Automotive and Energy Industries in the Early

(56) References Cited

OTHER PUBLICATIONS

21st Century: What Are the Prospects for Sensors?", Sensors and Actuators B, vol. 121, pp. 639-651, 2007.
"Aftertreatment Modeling of RCCI Engine During Transient Operation," University of Wisconsin—-Engine Research Center, 1 page, May 31, 2014.
"Chapter 14: Pollutant Formation," Fluent Manual, Release 15.0, Chapter 14, pp. 313-345, prior to Jan. 29, 2016.
"Chapter 21, Modeling Pollutant Formation," Fluent Manual, Release 12.0, Chapter 21, pp. 21-1-21-54, Jan. 30, 2009.
"J1979 E/E Diagnostic Test Modules," Proposed Regulation, Vehicle E.E. System Diagnostic Standards Committee, 1 page, Sep. 28, 2010.
"MicroZed Zynq Evaluation and Development and System on Module, Hardware User Guide," Avnet Electronics Marketing, Version 1.6, Jan. 22, 2015.
Actron, "Elite AutoScanner Kit—Enhanced OBD I & II Scan Tool, OBD 1300," Downloaded from https://actron.com/content/elite-autoscanner-kit-enhanced-obd-i-and-obd-ii-scan-tool?utm_ . . . , 5 pages, printed Sep. 27, 2016.
Andersson et al., "A Predictive Real Time NOx Model for Conventional and Partially Premixed Diesel Combustion," SAE International 2006-01-3329, 10 pages, 2006.
Andersson et al., "A Real Time NOx Model for Conventional and Partially Premixed Diesel Combustion," SAE Technical Paper Series 2006-01-0195, 2006 SAE World Congress, 13 pages, Apr. 3-6, 2006.
Andersson et al., "Fast Physical NOx Prediction in Diesel Engines, The Diesel Engine: The Low CO2 and Emissions Reduction Challenge," Conference Proceedings, Lyon, 2006. Unable to Obtain a Copy of This Reference.
Arregle et al., "On Board NOx Prediction in Diesel Engines: A Physical Approach," Automotive Model Predictive Control, Models Methods and Applications, Chapter 2, 14 pages, 2010.
Asprion, "Optimal Control of Diesel Engines," PHD Thesis, Diss ETH No. 21593, 436 pages, 2013.
Assanis et al., "A Predictive Ignition Delay Correlation Under Steady-State and Transient Operation of a Direct Injection Diesel Engine," ASME, Journal of Engineering for Gas Turbines and Power, vol. 125, pp. 450-457, Apr. 2003.
Bako et al., "A Recursive Identification Algorithm for Switched Linear/Affine Models," Nonlinear Analysis: Hybrid Systems, vol. 5, pp. 242-253, 2011.
Barba et al., "A Phenomenological Combustion Model for Heat Release Rate Prediction in High-Speed DI Diesel Engines with Common Rail Injection," SAE Technical Paper Series 2000-01-2933, International Fall Fuels and Lubricants Meeting Exposition, 15 pages, Oct. 16-19, 2000.
Blanco-Rodriguez, "Modelling and Observation of Exhaust Gas Concentrations for Diesel Engine Control," Phd Dissertation, 242 pages, Sep. 2013.
Blue Streak Electronics Inc., "Ford Modules," 1 page, May 12, 2010.
Bourn et al., "Advanced Compressor Engine Controls to Enhance Operation, Reliability and Integrity," Southwest Research Institute, DOE Award No. DE-FC26-03NT41859, SwRI Project No. 03.10198, 60 pages, Mar. 2004.
Charalampidis et al., "Computationally Efficient Kalman Filtering for a Class of Nonlinear Systems," IEEE Transactions an Automatic Control, vol. 56, No. 3, pp. 483-491, Mar. 2011.
Chew, "Sensor Validation Scheme with Virtual NOx Sensing for Heavy Duty Diesel Engines," Master's Thesis, 144 pages, 2007.
Extended European Search Report for EP Application No. 15155295.7-1606, dated Aug. 4, 2015.
Extended European Search Report for EP Application No. 15179435.1, dated Apr. 1, 2016.
Desantes et al., "Development of NOx Fast Estimate Using NOx Sensor," EAEC 2011 Congress, 2011. Unable to Obtain a Copy of This Reference.
Ding, "Characterising Combustion in Diesel Engines, Using Parameterised Finite Stage Cylinder Process Models," 281 pages, Dec. 21, 2011.
Docquier et al., "Combustion Control and Sensors: a Review," Progress in Energy and Combustion Science, vol. 28, pp. 107-150, 2002.
Egnell, "Combustion Diagnostics by Means of Multizone Heat Release Analysis and NO Calculation," SAE Technical Paper Series 981424, International Spring Fuels and Lubricants Meeting and Exposition, 22 pages, May 4-6, 1998.
Ericson, "NOx Modelling of a Complete Diesel Engine/SCR System," Licentiate Thesis, 57 pages, 2007.
Finesso et al., "Estimation of the Engine-Out NO2/NOx Ration in a Euro VI Diesel Engine," SAE International 2013-01-0317, 15 pages, Apr. 8, 2013.
Fleming, "Overview of Automotive Sensors," IEEE Sensors Journal, vol. 1, No. 4, pp. 296-308, Dec. 2001.
Ford Motor Company, "2012 My OBD System Operation Summary for 6.7L Diesel Engines," 149 pages, Apr. 21, 2011.
Formentin et al., "NOx Estimation in Diesel Engines via In-Cylinder Pressure Measurement," IEEE Transactions on Control Systems Technology, vol. 22, No. 1, pp. 396-403, Jan. 2014.
Galindo, "An On-Engine Method for Dynamic Characterisation of NOx Concentration Sensors," Experimental Thermal and Fluid Science, vol. 35, pp. 470-476, 2011.
Gamma Technologies, "Exhaust Aftertreatment with GT-Suite," 2 pages, Jul. 17, 2014.
Goodwin, "Researchers Hack A Corvette's Brakes via Insurance Black Box," Downloaded from http://www.cnet.com/roadshow/news/researchers-hack-a-corvettes-brakes-via-insurance-black-box/, 2 pages, Aug. 2015.
Greenberg, "Hackers Remotely Kill A Jeep On The Highway—With Me In It," Downloaded from http://www.wired.com/2015/07/hackers-remotely-kill-jeep-highway/, 24 pages, Jul. 21, 2015.
Guardiola et al., "A Bias Correction Method for Fast Fuel-to-Air Ratio Estimation in Diesel Engines," Proceedings of the Institution of Mechanical Engineers, Part D: Journal of Automobile Engineering, vol. 227, No. 8, pp. 1099-1111, 2013.
Guardiola et al., "A Computationally Efficient Kalman Filter Based Estimator for Updating Look-Up Tables Applied to NOx Estimation in Diesel Engines," Control Engineering Practice, vol. 21, pp. 1455-1468.
Guzzella et al., "Introduction to Modeling and Control of Internal Combustion Engine Systems," 303 pages, 2004.
Hahlin, "Single Cylinder ICE Exhaust Optimization," Master's Thesis, retrieved from https://pure.ltu.se/portal/files/44015424/LTU-EX-2013-43970821.pdf, 50 pages, Feb. 1, 2014.
Hammacher Schlemmer, "The Windshield Heads Up Display," Catalog, p. 47, prior to Apr. 26, 2016.
Heywood, "Pollutant Formation and Control," Internal Combustion Engine Fundamentals, pp. 567-667, 1988.
Hirsch et al., "Dynamic Engine Emission Models," Automotive Model Predictive Control, Chapter 5, 18 pages, LNCIS 402, 2012.
Hirsch et al., "Grey-Box Control Oriented Emissions Models," The International Federation of Automatic Control (IFAC), Proceedings of the 17th World Congress, pp. 8514-8519, Jul. 6-11, 2008.
Hockerdal, "EKF-based Adaptation of Look-Up Tables with an Air Mass-Flow Sensor Application," Control Engineering Practice, vol. 19, 12 pages, 2011.
http://nexceris.com/news/nextech-materials/, "NEXTECH Materials is Now NEXCERIS," 7 pages, printed Oct. 4, 2016.
http://www.arb.ca.gov/msprog/obdprog/hdobdreg.htm, "Heavy-Duty OBD Regulations and Rulemaking," 8 pages, printed Oct. 4, 2016.
https://www.dieselnet.com/standards/us/obd.php, "Emission Standards: USA: On-Board Diagnostics," 6 pages, printed Oct. 3, 2016.
https://www.en.wikipedia.org/wiki/Public-key_cryptography, "Public-Key Cryptography," 14 pages, printed Feb. 26, 2016.
Ishida et al., "An Analysis of the Added Water Effect on NO Formation in D.I. Diesel Engines," SAE Technical Paper Series 941691, International Off-Highway and Power-Plant Congress and Exposition, 13 pages, Sep. 12-14, 1994.

(56) References Cited

OTHER PUBLICATIONS

Ishida et al., "Prediction of NOx Reduction Rate Due to Port Water Injection in a DI Diesel Engine," SAE Technical Paper Series 972961, International Fall Fuels and Lubricants Meeting and Exposition, 13 pages, Oct. 13-16, 1997.
Jensen, "The 13 Monitors of an OBD System," http://www.oemoffhighway.com/article/1 0855512/the-13-monito . . . , 3 pages, printed Oct. 3, 2016.
"Model Predictive Control Toolbox Release Notes," The Mathworks, 24 pages, Oct. 2008.
"Model Predictive Control," Wikipedia, pp. 1-5, Jan. 22, 2009. http://en.wikipedia.org/w/index.php/title=Special:Book&bookcmd=download&collecton_id=641cdlb5da77cc22&writer=rl&return_to=Model predictive control, retrieved Nov. 20, 2012.
"MPC Implementation Methods for the Optimization of the Response of Control Valves to Reduce Variability," Advanced Application Note 002, Rev. A, 10 pages, 2007.
"SCR, 400-csi Coated Catalyst," Leading NOx Control Technologies Status Summary, 1 page prior to Feb. 2, 2005.
Advanced Petroleum-Based Fuels-Diesel Emissions Control (APBF-DEC) Project, "Quarterly Update," No. 7, 6 pages, Fall 2002.
Allanson, et al., "Optimizing the Low Temperature Performance and Regeneration Efficiency of the Continuously Regenerating Diesel Particulate Filter System," SAE Paper No. 2002-01-0428, 8 pages, Mar. 2002.
Amstuz, et al., "EGO Sensor Based Robust Output Control of EGR in Diesel Engines," IEEE TCST, vol. 3, No. 1, 12 pages, Mar. 1995.
Axehill et al., "A Dual Gradiant Projection Quadratic Programming Algorithm Tailored for Model Predictive Control," Proceedings of the 47th IEEE Conference on Decision and Control, Cancun Mexico, pp. 3057-3064, Dec. 9-11, 2008.
Axehill et al., "A Dual Gradient Projection Quadratic Programming Algorithm Tailored for Mixed Integer Predictive Control," Technical Report from Linkopings Universitet, Report No. Li-Th-ISY-R-2833, 58 pages, Jan. 31, 2008.
Baffi et al., "Non-Linear Model Based Predictive Control Through Dynamic Non-Linear Partial Least Squares," Trans IChemE, vol. 80, Part A, pp. 75-86, Jan. 2002.
Bemporad et al., "Model Predictive Control Toolbox 3, User's Guide," Matlab Mathworks, 282 pages, 2008.
Bemporad et al., "The Explicit Linear Quadratic Regulator for Constrained Systems," Automatica, 38, pp. 3-20, 2002.
Bemporad, "Model Predictive Control Based on Linear Programming—The Explicit Solution," IEEE Transactions on Automatic Control, vol. 47, No. 12, pp. 1974-1984, Dec. 2002.
Bemporad, "Model Predictive Control Design: New Trends and Tools," Proceedings of the 45$^{th}$ IEEE Conference on Decision & Control, pp. 6678-6683, Dec. 13-15, 2006.
Bemporad, et al., "Explicit Model Predictive Control," 1 page, prior to Feb. 2, 2005.
Bertsekas, "On the Goldstein-Levitin-Polyak Gradient Projection Method," IEEE Transactions on Automatic Control, vol. AC-21, No. 2, pp. 174-184, Apr. 1976.
Bertsekas, "Projected Newton Methods for Optimization Problems with Simple Constraints*," Siam J. Control and Optimization, vol. 20, No. 2, pp. 221-246, Mar. 1982.
Borrelli et al., "An MPC/Hybrid System Approach to Traction Control," IEEE Transactions on Control Systems Technology, vol. 14, No. 3, pp. 541-553, May 2006.
Borrelli, "Constrained Optimal Control of Linear and Hybrid Systems," Lecture Notes in Control and Information Sciences, vol. 290, 2003.
Borrelli, "Discrete Time Constrained Optimal Control," A Dissertation Submitted to the Swiss Federal Institute of Technology (ETH) Zurich, Diss. ETHNo. 14666, 232 pages, Oct. 9, 2002.
Catalytica Energy Systems, "Innovative NOx Reduction Solutions for Diesel Engines," 13 pages, 3rd Quarter, 2003.
Chatterjee, et al. "Catalytic Emission Control for Heavy Duty Diesel Engines," JM, 46 pages, prior to Feb. 2, 2005.
Search Report for Corresponding EP Application No. 11167549.2 dated Nov. 27, 2012.
De Oliveira, "Constraint Handling and Stability Properties of Model Predictive Control," Carnegie Institute of Technology, Department of Chemical Engineering, Paper 197, 64 pages, Jan. 1, 1993.
De Schutter et al., "Model Predictive Control for Max-Min-Plus-Scaling Systems," Proceedings of the 2001 American Control Conference, Arlington, Va, pp. 319-324, Jun. 2001.
Delphi, Delphi Diesel NOx Trap (DNT), 3 pages, Feb. 2004.
Diehl et al., "Efficient Numerical Methods for Nonlinear MPC and Moving Horizon Estimation," Int. Workshop on Assessment and Future Directions of NMPC, 24 pages, Pavia, Italy, Sep. 5-9, 2008.
Dunbar, "Model Predictive Control: Extension to Coordinated Multi-Vehicle Formations and Real-Time Implementation," CDS Technical Report 01-016, 64 pages, Dec. 7, 2001.
GM "Advanced Diesel Technology and Emissions," powertrain technologies—engines, 2 pages, prior to Feb. 2, 2005.
Guerreiro et al., "Trajectory Tracking Nonlinear Model Predictive Control for Autonomous Surface Craft," Proceedings of the European Control Conference, Budapest, Hungary, 6 pages, Aug. 2009.
Guzzella, et al., "Control of Diesel Engines," IEEE Control Systems Magazine, pp. 53-71, Oct. 1998.
Havelena, "Componentized Architecture for Advanced Process Management," Honeywell International, 42 pages, 2004.
Hiranuma, et al., "Development of DPF System for Commercial Vehicle—Basic Characteristic and Active Regeneration Performance," SAE Paper No. 2003-01-3182, Mar. 2003.
Honeywell, "Profit Optimizer A Distributed Quadratic Program (DQP) Concepts Reference," 48 pages, prior to Feb. 2, 2005.
http://www.not2fast.wryday.com/turbo/glossary/turbo_glossary.shtml, "Not2Fast: Turbo Glossary," 22 pages, printed Oct. 1, 2004.
http://www.tai-cwv.com/sbll06.0.html, "Technical Overview—Advanced Control Solutions," 6 pages, printed Sep. 9, 2004.
Johansen et al., "Hardware Architecture Design for Explicit Model Predictive Control," Proceedings of ACC, 6 pages, 2006.
Johansen et al., "Hardware Synthesis of Explicit Model Predictive Controllers," IEEE Transactions on Control Systems Technology, vol. 15, No. 1, Jan. 2007.
Jonsson, "Fuel Optimized Predictive Following in Low Speed Conditions," Master's Thesis, 46 pages, Jun. 28, 2003.
Kelly, et al., "Reducing Soot Emissions from Diesel Engines Using One Atmosphere Uniform Glow Discharge Plasma," SAE Paper No. 2003-01-1183, Mar. 2003.
Keulen et al., "Predictive Cruise Control in Hybrid Electric Vehicles", May 2009, World Electric Journal, vol. 3, ISSN 2032-6653.
Kolmanovsky, et al., "Issues in Modeling and Control of Intake Flow in Variable Geometry Turbocharged Engines", 18th IFIP Conf. System Modeling and Optimization, pp. 436-445, Jul. 1997.
Kulhavy, et al. "Emerging Technologies for Enterprise Optimization in the Process Industries," Honeywell, 12 pages, Dec. 2000.
Locker, et al., "Diesel Particulate Filter Operational Characterization," Corning Incorporated, 10 pages, prior to Feb. 2, 2005.
Lu, "Challenging Control Problems and Engineering Technologies in Enterprise Optimization," Honeywell Hi-Spec Solutions, 30 pages, Jun. 4-6, 2001.
Maciejowski, "Predictive Control with Constraints," Prentice Hall, Pearson Education Limited, 4 pages, 2002.
Mariethoz et al., "Sensorless Explicit Model Predictive Control of the DC-DC Buck Converter with Inductor Current Limitation," IEEE Applied Power Electronics Conference and Exposition, pp. 1710-1715, 2008.
Marjanovic, "Towards a Simplified Infinite Horizon Model Predictive Controller," 6 pages, Proceedings of the 5$^{th}$ Asian Control Conference, 6 pages, Jul. 20-23, 2004.
Mayne et al., "Constrained Model Predictive Control: Stability and Optimality," Automatica, vol. 36, pp. 789-814, 2000.
Mehta, "The Application of Model Predictive Control to Active Automotive Suspensions," 56 pages, May 17, 1996.
Moore, "Living with Cooled-EGR Engines," Prevention Illustrated, 3 pages, Oct. 3, 2004.
Murayama et al., "Speed Control of Vehicles with Variable Valve Lift Engine by Nonlinear MPC," ICROS-SICE International Joint Conference, pp. 4128-4133, 2009.

(56) References Cited

OTHER PUBLICATIONS

National Renewable Energy Laboratory (NREL), "Diesel Emissions Control-Sulfur Effects Project (DECSE) Summary of Reports," U.S. Department of Energy, 19 pages, Feb. 2002.
Ortner et al., "MPC for a Diesel Engine Air Path Using an Explicit Approach for Constraint Systems," Proceedings of the 2006 IEEE Conference on Control Applications, Munich Germany, pp. 2760-2765, Oct. 4-6, 2006.
Ortner et al., "Predictive Control of a Diesel Engine Air Path," IEEE Transactions on Control Systems Technology, vol. 15, No. 3, pp. 449-456, May 2007.
Pannocchia et al., "Combined Design of Disturbance Model and Observer for Offset-Free Model Predictive Control," IEEE Transactions on Automatic Control, vol. 52, No. 6, 6 pages, 2007.
Qin et al., "A Survey of Industrial Model Predictive Control Technology," Control Engineering Practice, 11, pp. 733-764, 2003.
Rajamani, "Data-based Techniques to Improve State Estimation in Model Predictive Control," Ph.D, Dissertation, 257 pages, 2007.
Rawlings, "Tutorial Overview of Model Predictive Control," IEEE Control Systems Magazine, pp. 38-52, Jun. 2000.
Salvat, et al., "Passenger Car Serial Application of a Particulate Filter System on a Common Rail Direct Injection Engine," SAE Paper No. 2000-01-0473, 14 pages, Feb. 2000.
Schauffele et al., "Automotive Software Engineering Principles, Processes, Methods, and Tools," SAE International, 10 pages, 2005.
Shamma, et al. "Approximate Set-Valued Observers for Nonlinear Systems," IEEE Transactions on Automatic Control, vol. 42, No. 5, May 1997.
Soltis, "Current Status of NOx Sensor Development," Workshop on Sensor Needs and Requirements for PEM Fuel Cell Systems and Direct-Injection Engines, 9 pages, Jan. 25-26, 2000.
Stefanopoulou, et al., "Control of Variable Geometry Turbocharged Diesel Engines for Reduced Emissions," IEEE Transactions on Control Systems Technology, vol. 8, No. 4, pp. 733-745, Jul. 2000.
Stewart et al., "A Model Predictive Control Framework for Industrial Turbodiesel Engine Control," Proceedings of the 47$^{th}$ IEEE Conference on Decision and Control, 8 pages, 2008.
Stewart et al., "A Modular Model Predictive Controller for Turbodiesel Problems," First Workshop on Automotive Model Predictive Control, Schloss Muhldorf, Feldkirchen, Johannes Kepler University, Linz, 3 pages, 2009.
Storset, et al., "Air Charge Estimation for Turbocharged Diesel Engines," vol. 1 Proceedings of the American Control Conference, 8 pages, Jun. 28-30, 2000.
Takacs et al., "Newton-Raphson Based Efficient Model Predictive Control Applied on Active Vibrating Structures," Proceeding of the European Control Conference 2009, Budapest, Hungary, pp. 2845-2850, Aug. 23-26, 2009.
The MathWorks, "Model-Based Calibration Toolbox 2.1 Calibrate complex powertrain systems," 4 pages, prior to Feb. 2, 2005.
The MathWorks, "Model-Based Calibration Toolbox 2.1.2," 2 pages, prior to Feb. 2, 2005.
Theiss, "Advanced Reciprocating Engine System (ARES) Activities at the Oak Ridge National Lab (ORNL), Oak Ridge National Laboratory," U.S. Department of Energy, 13 pages, Apr. 14, 2004.
Tondel et al., "An Algorithm for Multi-Parametric Quadratic Programming and Explicit MPC Solutions," Automatica, 39, pp. 489-497, 2003.
Van Basshuysen et al., "Lexikon Motorentechnik," (Dictionary of Automotive Technology) published by Vieweg Verlag, Wiesbaden 039936, p. 518, 2004, (English Translation).
Van Den Boom et al., "MPC for Max-Plus-Linear Systems: Closed-Loop Behavior and Tuning," Proceedings of the 2001 American Control Conference, Arlington, Va, pp. 325-330, Jun. 2001.
Van Keulen et al., "Predictive Cruise Control in Hybrid Electric Vehicles," World Electric Vehicle Journal vol. 3, ISSN 2032-6653, pp. 1-11, 2009.
Wang et al., "Fast Model Predictive Control Using Online Optimization," Proceedings of the 17$^{th}$ World Congress, the International Federation of Automatic Control, Seoul, Korea, pp. 6974-6979, Jul. 6-11, 2008.
Wang et al., "PSO-Based Model Predictive Control for Nonlinear Processes," Advances in Natural Computation, Lecture Notes in Computer Science, vol. 3611/2005, 8 pages, 2005.
Wright, "Applying New Optimization Algorithms to Model Predictive Control," 5th International Conference on Chemical Process Control, 10 pages, 1997.
Zavala et al., "The Advance-Step NMPC Controller: Optimality, Stability, and Robustness," Automatica, vol. 45, pp. 86-93, 2009.
Zeilinger et al., "Real-Time MPC—Stability Through Robust MPC Design," Joint 48$^{th}$ IEEE Conference on Decision and Control and 28$^{th}$ Chinese Control Conference, Shanghai, P.R. China, pp. 3980-3986, Dec. 16-18, 2009.
Zelenka, et al., "An Active Regeneration as a Key Element for Safe Particulate Trap Use," SAE Paper No. 2001-0103199, 13 pages, Feb. 2001.
Zhu, "Constrained Nonlinear Model Predictive Control for Vehicle Regulation," Dissertation, Graduate School of the Ohio State University, 125 pages, 2008.

* cited by examiner

ENGINE SYSTEM WITH INFERENTIAL SENSOR

This application is a continuation of U.S. patent application Ser. No. 15/011,445, filed Jan. 29, 2016. U.S. patent application Ser. No. 15/011,445, filed Jan. 29, 2016, is hereby incorporated by reference.

BACKGROUND

The present disclosure pertains to internal combustion engines and particularly to engines having one or more sensors.

SUMMARY

The disclosure reveals an engine, one or more sensors, and a controller integrated into an engine system. The controller may be one or more control units connected to the engine and/or the one or more sensors. The controller may contain and execute a program for control of the engine system or for diagnostics of the engine system. The controller may incorporate an air-path state estimator configured to estimate one or more air-path state parameters related to the operation of the engine based, at least in part, on values of one or more parameters sensed by the sensors. In an off-line portion of the controller calibration algorithm, a model for the air-path state estimator may be configured and/or calibrated for the engine. The configured and/or calibrated model may be provided to the air-path state estimator in an on-line portion of the controller to provide air-path state parameter value estimates in real-time during operation of the engine.

DESCRIPTION

Figure 1:
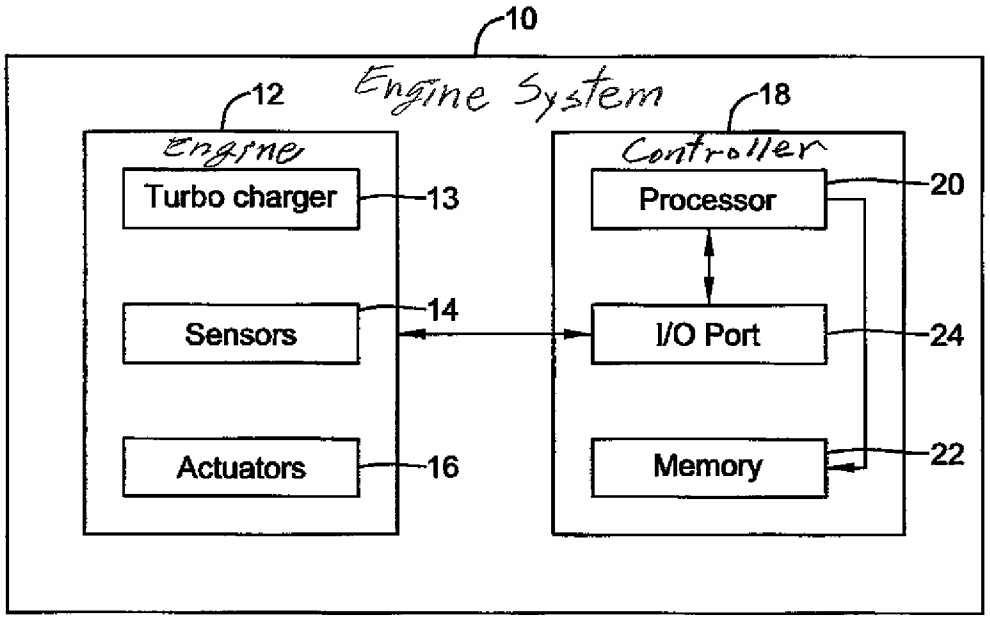
FIG. 1 is a diagram of an illustrative example of an engine system.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

Modern combustion engines may be complex systems with modern engine control or diagnostics systems that are model based and implemented with model based software in a controller (e.g., one or more electronic control unit (ECU) or electronic control module (ECM) having one or more control algorithms) of an engine system. However, an engine model may not need to be complex and/or difficult to run in a simulation to be an accurate model of an engine. In one example, there may exist different models with similar input and output behavior, but with dramatically different numerical properties, solution complexity, and requirements for computational power. Thus, as a control system memory footprint and/or computational power needed by model based software in which the engine model (e.g., an engine model used in a control system) is implemented, may be largely dependent on the model complexity and numerical properties for the model; it may be effective to have a simple and numerically convenient engine model that may meet a required accuracy level when implementing a real-time model based estimator, inferential sensor, and/or controller (e.g., for controlling an engine).

Differential equations resulting from combustion engine physics may be stiff and difficult to solve numerically, particularly in real time during operation of an engine. In one example, a gas exchange model of an internal combustion engine air path (e.g., a model of engine breathing) resulting from first principles of physics may be a set of ordinary differential equations (ODEs) that is highly complex:

$$\frac{dx_j}{dt} = f_j(t, x_1, x_2, \ldots, x_n),\ j \in \{1, 2, \ldots, n\}. \tag{1}$$

Here $x_j$ may be state variables of the internal combustion engine air path and t may be time. The ODE model of equation (1) may be considered to be very stiff and numerically inconvenient. Illustratively, the model stiffness may be caused by the form of equation (1), which may have non-linear components and/or components that are described by non-differentiable functions. The numerical properties of the model represented by equation (1) (e.g., a mean value model of an internal combustion engine, which is a model that may be averaged over an engine cycle) may be fully defined by right-hand side functions, $f_j$. These functions, $f_j$, may have numerical properties that could result in the equations being difficult to solve. For example, the functions on the right-hand side of the equation may include non-linear components and/or may not be differentiable because, in this example, the functions' derivatives with respect to x are not bounded for some values of x. Examples of functions with non-linear components and/or that are not differentiable may include functions with derivatives that include power functions with an exponent less than one, or ratios of functions, and/or other complex functions composed from rational and power functions, where the denominator may be zero or tend to (e.g., approach or become close to) zero. These functional forms may be completely correct for modeling an engine as they may be given by physics of gas and energy flow in the engine, but the complexity of the numerical properties of functions including these functional forms may make it difficult to use the functions in fast simulations and/or real-time optimizations (e.g., to model engines during operation of the engine).

When calculating local linearization of differential equations, such as in equation (1) close to a point where some of $f_j$ are not differentiable, a Jacobian matrix J, as seen in equation (2) may be ill-conditioned.

$$J = \begin{pmatrix} \frac{\partial f_1}{\partial x_1} & \cdots & \frac{\partial f_n}{\partial x_1} \\ \vdots & \ddots & \vdots \\ \frac{\partial f_1}{\partial x_1} & \cdots & \frac{\partial f_n}{\partial x_n} \end{pmatrix} \tag{2}$$

In some cases, the ill-conditioning may be caused by some of the partial derivatives being unbounded. As a result, eigenvalues of the Jacobian matrix may have differing magnitudes and may produce model stiffness. Moreover, model stiffness may tend to worsen when approaching points of unbounded Jacobian elements and in a limit; the ratio of eigenvalues may tend to infinity. Stiff model simulation (e.g., simulation of a model represented by equation (1)) may be possible with specially configured solvers, but the processing power needed may be too great to solve on a controller configured to control an engine (e.g., one or more ECUs and/or ECMs).

Instead of simulating a stiff model, an original physical model (e.g., a model of the engine that may be stiff) that may be changed to a set of equations, which may be much easier to solve (e.g., easier to solve from a computational or processing power perspective), may be utilized to model the engine. An example approach of transforming the stiff engine model to a more easily solved engine model that may be the same or lower order than the stiff engine model may include transforming the right-side functions of the engine models derived from first principles of physics (e.g., equation (1)) with fractions of differentiable functions. Then the differential equations with denominators that tend to zero may be converted to implicit equations after which the stiffness (e.g., fast dynamics) from the engine model may be mitigated and/or eliminated. This may result in a differential algebraic equation (DAE) model structure. After mitigating and/or eliminating the stiffness from the engine model, a transformed solution of eliminated states may be provided and the transformed solutions may replace the eliminated states in the DAEs and differentiable functions. Such an approach may be described as follows.

ODE models of a system may be changed into or converted to a differential algebraic equation (DAE) model of the system. A classic model of a dynamic system may be a set of first order differential equations in the time domain, as follows:

$$\frac{dx(t)}{dt} = f(t, x(t)) \tag{3}$$

In some cases, as discussed herein, control oriented models used in an automotive industry (e.g., for internal combustion engines) may have the form of equation (3). Such ODE functions may not necessarily be convenient, but an ODE function may be converted to a DAE that may be more convenient and may be an implicit equation taking a general form of:

$$F\left(\frac{dx(t)}{dt}, t, x(t)\right) = 0 \tag{4}$$

Further, it may be possible to isolate the time derivatives from equation (4), which may result in a model having a semi-explicit form with the following equations:

$$\frac{dx_1(t)}{dt} = f_1(t, x_1(t), x_2(t)) \tag{5}$$

$$0 = f_2(t, x_1(t), x_2(t)) \tag{6}$$

It has been found that an ODE model of an internal combustion engine (e.g., similar to equation (1)) may be converted to a DAE model automatically or semi-automatically with minimum effort using the disclosed approach. The initial transformation step of the approach may replace some of the right hand side functions (e.g., functions, $f_i$) with multivariate rational polynomials functions and remaining functions (e.g., functions, $f_k$) with multivariate polynomial functions. An example rational polynomial function follows:

$$\frac{dx_i}{dt} = \frac{b_i(t, x_1, x_2, \ldots, x_n)}{a_i(t, x_1, x_2, \ldots, x_n)}, i \in E. \tag{7}$$

Rational polynomials functions may be used to transform the non-differentiable functions (e.g., the square root functions if the argument is not sufficiently non-zero, similar functions appearing in the laws of thermodynamics, chemical kinetics, turbo-machinery, and so forth). Such functions may be the type used to model compressible fluid orifice flow, and the like in an internal combustion engine, and/or used to model other systems. The choice of transforming functions with rational polynomial functions may be of interest, as polynomial functions, for example, may be less efficient for transforming non-differentiable functions than rational polynomials.

The remaining functions, $f_k$, may either be smooth and differentiable or may be considered practically differentiable, where non-differentiability of the function may not happen for normal values of x. These functions $f_k$ may be transformed with the following polynomial functions:

$$\frac{dx_k}{dt} = p_k(t, x_1, x_2, \ldots, x_n), k \notin E. \tag{8}$$

The second step of the approach may incorporate multiplication of the transformed equations $t \in E$ (e.g., the rational polynomials, as in equation (7)) with the denominators, resulting in the following equation:

$$\frac{dx_i}{dt} a_i(t, x_1, x_2, \ldots, x_n) - b_i(t, x_1, x_2, \ldots, x_n) = 0. \tag{9}$$

This step of the approach may result in a system with implicit but differentiable equations. That is, the non-differentiability in the functions may be removed by the multiplication.

The third step may include removing model stiffness (e.g., eliminating the fast dynamics) from the model. In one example, this step may replace, if there are any, denominators $a_j(t,x_1,x_2, \ldots, x_n)$ which can get small (e.g., tend to zero). From this, some equations may be changed into the following algebraic equations:

$$b_i(t,x_1,x_2, \ldots ,x_n)=0. \tag{10}$$

After this step, the system of ODEs (e.g., as in equation (1)) may be changed into a system of DAEs with differentiable functions, which may be equivalent to assuming all or substantially all fast dynamics of the functions may be in steady state.

At the next step, the variables $x_i$ may be isolated from the algebraic polynomial equations $b_i=0$. Typically it may not be possible to do this step analytically, as the variables $x_i$ may only be approximately isolated. This transformation may be represented by multivariate polynomial functions $g_i$, as follows:

$$x_i = g_i(t, x_k), k \notin E. \tag{11}$$

Next, using the results from the previous step, the eliminated states $x_i$ may be replaced with $g_i(t,x_k)$ in the remaining differential equations. Thus the DAEs may become a smaller system (e.g., lower order than equation (1)) of ODE's, which may transform the original model (e.g., equation (1)):

$$\frac{dx_k}{dt} = p_k(t, g_i(t, x_k), x_k) = q_k(t, x_k). \tag{12}$$

Here, the polynomial functions $q_k(t,x_k)$ may be differentiated analytically, so the Jacobian matrix may be prepared for real-time control optimization and state estimation tasks (e.g., when implementing in an ECM to control an engine and/or in one or more other control applications or other applications).

Turning to one example implementation of the above conversions with respect to modeling an internal combustion engine, such a conversion technique may be used to configure a virtual sensor (e.g., inferential or soft sensor) that uses measurements or values from physical sensors sensing parameters of an engine to estimate and/or determine values for parameters related to the engine that may or may not be sensed by physical sensors. Such virtual sensors may include an air-path state estimator, a NOx concentration sensor, a turbocharger speed sensor, one or more other virtual sensors, and any combination of virtual sensors. Although the disclosed subject matter may be described with respect to an example related to air-path state estimation and NOx concentration virtual sensing that may output NOx concentration values in exhaust gas from an engine, the concepts herein may be utilized in other virtual sensors of an engine or other system and/or in other models where processing power may be limited. The virtual sensor, along with any control program of the controller, may be implemented in memory as software code compiled and executed by a processor of the controller.

Illustratively, $NO_x$ (e.g., where $NO_x$ may be a general term used to describe mono-nitrogen oxides NO and $NO_2$) emissions from an internal combustion engine may be strictly regulated by authorities (e.g., government authorities). NOx may be produced in a cylinder of an engine as a result of oxidation of atmospheric Nitrogen. An oxidation rate of atmospheric Nitrogen in exhaust gas from an engine may be dependent on a temperature and an amount of oxygen available. An ECU/ECM or other controller may adjust control parameters for the engine in real time in order to avoid conditions which may lead to excessive NOx formation in a combustion chamber of the engine. As a result, a controller (e.g., one or more ECU/ECM and/or other controller) may be configured to monitor temperature and oxygen content in the combustion chamber of the engine. In one example, the controller may be configured to avoid high temperatures in a cylinder of an engine in combination with lean combustion (e.g., combustion with excess oxygen). Such monitoring may be particularly relevant when an engine is not equipped with de-NOx technology (e.g., most small and medium diesel vehicles do not include such de-NOx technology). In some cases, a controller may utilize a feedback loop because the NOx formation process may be affected by one or more uncertain variables affecting the combustion process (e.g., fuel composition, how fuel may be atomized during injection, combustion delay, exact mass and composition of gas charged to the cylinder of the engine, and so on).

Reliable feedback control of the NOx emissions may be based on a physical NOx on-board sensor/analyzer. In one example, a physical sensor/analyzer may convert NOx concentration to an electrical voltage. However, such a physical sensor/analyzer may be a relatively costly device, and ensuring its reliable operation over the entire vehicle life may be difficult, as the physical sensor/analyzer may operate in the exhaust stream where the conditions may be harsh. Another problem with a physical sensor/analyzer may be cross-sensitivity of the sensor/analyzer to compounds different than NOx (e.g., ammonia, and so on).

For these reasons, a virtual sensor (e.g., a soft or inferential sensor) may be used to estimate NOx production from an engine based, at least in part, on other variables which can be measured on the engine as an alternative to, or in addition to, a NOx physical sensor/analyzer. Even if this soft sensing may not completely replace the NOx physical sensor/analyzer, it may help with sensor diagnostics and/or sensor health monitoring, as well as cross sensitivity issues.

Based, at least in part, on sensed parameters of physical sensors already in the engine, a NOx production rate or other engine parameter may be estimated by solving chemical kinetics equations in the in-cylinder space (e.g., in an in-cylinder space of an engine), while respecting the volume profile which may be given by the engine speed. Physical sensors in the engine may be able to facilitate determining initial conditions to solve these chemical kinetics equations and/or other equations related to determining parameter values. Notably variables including, but not limited to, mass, temperature, and chemical composition of the charged gas of the engine (which may not necessarily be fresh air, but may be a mixture of air and combustion product residuals) may be required to be known as initial conditions for solving the chemical kinetics equations and/or the other equations for estimating a parameter value. Additionally, and/or alternatively, other variables such as, but not limited to, an amount of injected fuel, injection timing, and gas composition may be required.

Initial conditions for estimating NOx production and/or for estimating other parameters of an engine or engine system may be estimated rather than sensed by physical sensors of the engine. As such, a virtual sensor or estimator module based on a gas exchange model may output temperature, composition, and mass of the charged gas, which may be utilized as initial conditions in a second virtual sensor (e.g., a virtual sensor configured to produce NOx flow estimates based on the initial conditions estimates, a virtual sensor configured to estimate a speed of a turbo charger, and so forth).

Turning to the Figures, FIG. 1 depicts an engine system 10. The engine system 10 may include an engine 12 and a controller 18 in communication with the engine 12. In some cases, the engine system 10 may include one or more additional components, including, but not limited to, a powertrain that may incorporate the engine 12, a powertrain controller, an exhaust gas aftertreatment system/mechanism, a drivetrain, a vehicle, and/or other component. Any reference herein to engine, powertrain, or aftertreatment system may be regarded as a reference to any other or all of these components.

The engine 12 may include one or more turbo chargers 13, one or more sensors 14, and one or more actuators 16. Examples of engine actuators 16 may include, but are not limited to actuators of a turbocharger waste gate (WG), a variable geometry turbocharger (VGT), an exhaust gas recirculation (EGR) system, a start of injection (SOI) system, a throttle valve (TV), and so on. The sensors 14 may be configured to sense positions of actuators and/or values of other engine variables or parameters and then communicate those values to the controller 18.

The controller 18 may be an ECM or ECU with a control system algorithm therein. The controller 18 may include one or more components having a processor 20, memory 22, an input/output (I/O) port 24, and/or one or more other components. The memory 22 may include one or more control system algorithms and/or other algorithms and the processor 20 may execute instructions (e.g., software code or other instructions) related to the algorithm(s) in the memory 22. The I/O port 24 may send and/or receive information and/or control signals to and/or from the engine 12. In one example, the I/O port 24 may receive values from the sensors 14 and/or send control signals from the processor 20 to the engine 12.

One illustrative example implementation of a virtual sensor in the engine system 10, the controller 18 of the engine system 10 may be configured to include a virtual sensor having two main components: 1) an air-path state estimator 26 (e.g., a virtual sensor or module that may provide an estimate of the air-path state in an engine based on actual measurements from sensors 14 in the engine 12), and 2) a NOx concentration module 27 (e.g., a NOx concentration virtual sensor having an in-cylinder process model of NOx formation). One may see FIG. 2. The air-path state estimator 26 may include a model of an air path of the engine averaged over an engine cycle. Such a model may be a model of a non-linear system with states that may be estimated on-line (e.g., during operation of the engine 12) using sensor measurements. The air-path state estimator 26 may provide boundary or initial values to one or more downstream sensors (NOx concentration module 27) and/or monitoring systems. In some cases, the air-path state estimator 26 may estimate one or more of an in-cylinder (e.g., a cylinder of the engine 12) charge temperature, an in-cylinder charge pressure, a concentration of gas at an intake valve closing, and/or one or more other parameters related to an air-path of an engine.

Virtual sensors utilizing initial conditions from the air-path state estimator 26 may be configured to run in real time on a vehicle controller or ECU (e.g., controller 18). The virtual sensor may able to predict or estimate engine parameter values (e.g., out-engine NOx concentration) with sufficient accuracy for both steady state and transient operation, while covering an entire or substantially an entire envelope of the engine and a relatively wide range of ambient conditions.

In some cases, model(s) of and/or used in the virtual sensors in controller 18 may include a number of parameters that may be calibrated in a series of experiments to achieve or improve accuracy of estimates from the virtual sensor. By considering physical interactions in the engine 12, the model of the virtual sensor may gain extrapolation ability to behave reasonably beyond a range of data used for calibration. Considering that the virtual sensor configuration may start from a physics based model, the calibrated parameters of the model may be mostly physical parameters with known physical interpretations and values known accurately or approximately. These physical parameters may be automatically transformed into other parameters (e.g., polynomial coefficients). This may distinguish the disclosed approach from other black-box modeling approaches (e.g., modeling not based on physics), where the parameters without a clear physical interpretation may be used for calibration and the calibration effort may be great because the number of completely unknown parameters is to be determined.

The model of the virtual sensor may be driven by variables of engine inputs and/or actuator positions. In one example, input variables may include EGR valve opening ($U_{EGR}$), VNT vane position, injected fuel quantity (fuel per stroke), ambient temperature, ambient pressure, ambient humidity, intake manifold pressure, intake manifold temperature, air mass flow (MAF), positions of a variable geometry turbocharger ($U_{VGT}$), and so on. Further, the model(s) in the virtual sensor may be affected by unmeasured disturbances such as variations in fuel quality, ambient air pressure, as well as variations in the operation of the engine 12 due to aging of components, but these effects may be compensated-for by using available sensor measurements by means of feedback corrections as it may be for state estimators (e.g., Kalman filter based state estimators).

Figure 2:
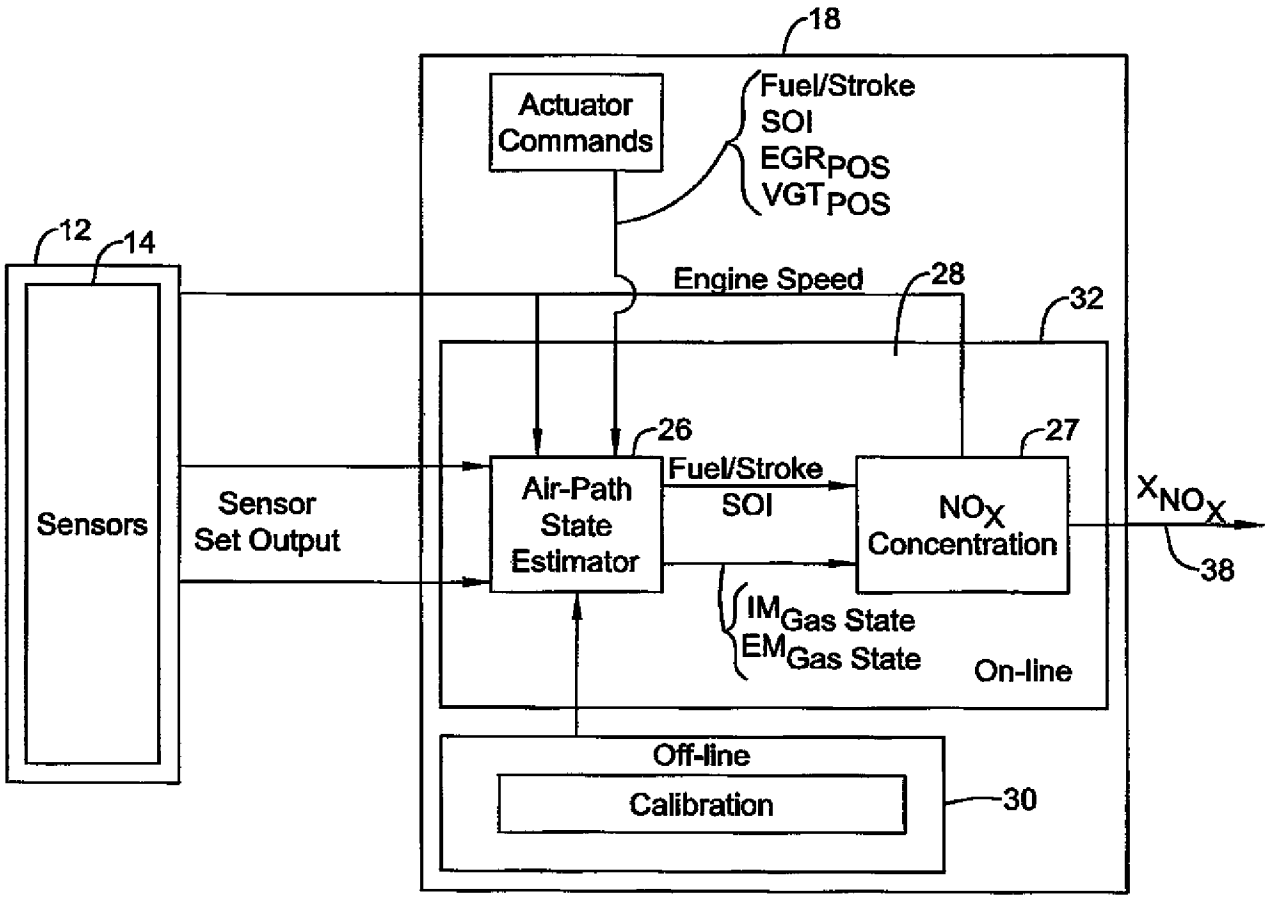
FIG. 2 is a diagram of an illustrative example of a controller or diagnostic system having an on-line portion and an off-line portion.

FIG. 2 is a diagram that depicts a schematic view of a virtual sensor 28 of a controller 18. Controller 18 may have an off-line portion 30 and an on-line portion 32. The off-line portion 30 of the controller 18 may be configured to determine one or more differential functions of an engine model for use by the air-path state estimator 26 in estimating parameter values of the engine 12 during operation of the engine 12.

The off-line portion 30 of the controller 18 may be configured to calibrate a model of the engine 12 for the specific engine 12 without current operating conditions of the engine (e.g., conditions of the engine during operation of the engine). As such, the operation of the off-line portion 30 of the controller 18 may not receive feedback from the operation of the engine 12 and may be separate from a feedback loop of the engine 12 used to control operation of the engine 12. The operations of the off-line portion 30 of the controller 18 may be described in greater detail with respect to FIG. 3.

The off-line portion 30 of the controller 18 may be on the same or different hardware as the on-line portion 32 of the controller 18. In one example, the off-line portion 30 of the controller 18 may be performed or located on a personal computer, laptop computer, server, and the like, that may be separate from the ECU/ECM or other controller of engine 12. In the example, parameters for the engine model may be obtained off-line and uploaded to the ECU/ECM during a manufacturing process of the engine 12 and/or as a future update during vehicle service. Alternatively, or in addition, the off-line portion 30 of the controller 18 may be performed on the ECU/ECM at or adjacent the engine 12.

The on-line portion 32 of the controller 18 may be located in a feedback loop for controlling operation of the engine 12. As such, the on-line portion 32 may utilize current conditions of parameters of the engine 12 to adjust and/or monitor engine 12 operations and/or outputs.

In FIG. 2, a virtual sensor 28 at least partially located in the on-line portion 32 of the controller 18 may be split into two parts: 1) the air-path state estimator 26, and 2) the NOx concentration module 27 representing an engine cylinder combustion model. As discussed, the air-path state estimator 26 may be or may include a mean-value model, where the variables for the model may be averaged over an engine cycle. The air-path state estimator 26 role may be to track states of parameters in intake and/or exhaust manifolds, where the tracked states of parameters (e.g., traces of states) may be used as boundary conditions for the NOx concentration module 27 an/or other downstream virtual sensors or diagnostics. Examples of tracked states of parameters may include, but are not limited to, intake/exhaust manifold pressures, intake manifold temperature, fractions of the main species entering cylinders of the engine, which may include $O_2$, $N_2$, $H_2O$, and/or $CO_2$, and/or other states of engine related parameters.

In one example, the air-path state estimator 26 may be configured to estimate unmeasured inputs to the NOx concentration module 27, which may include manifold gas conditions (e.g., an intake and/or exhaust manifold temperatures, an intake and/or exhaust manifold pressures, and intake and/or exhaust manifold concentrations of $O_2$, $N_2$, $H_2O$, and/or $CO_2$), among other possible conditions. The intake manifold gas conditions may be utilized for the NOx concentration module 27, as the intake manifold gas conditions may define the gas charged to the cylinder and that definition may be needed to determine NOx formation. Additionally, in some cases, exhaust manifold gas conditions may be utilized for the NOx concentration module 27, as the exhaust manifold gas conditions may define properties of residual gas left in dead space of the engine 12.

Illustratively, the air-path state estimator 26 may be a non-linear state observer based on a set of differential equations normally defined by the mean value model of the engine. There may be four types of the differential equations and their exact number and configuration may be determined by the architecture of the engine 12. In one example, some factors that may affect the configuration of the differential equations include, but are not limited to, whether the engine includes a single or dual stage turbocharger, whether the engine has a low or high pressure EGR, whether the engine has a backpressure valve or an intake throttle valve, or the like.

One of the four types of differential equations may be the differential equation of pressure between components in a volume, V, of the engine 12:

$$\frac{dp}{dt} = \frac{\gamma \tilde{R}}{pV}(\dot{m}_{in}T_{in} - \dot{m}_{out}T) \tag{13}$$

Here, $\tilde{R}$ [J/(kg K)] is the gas constant, $\gamma$ is dimensionless heat capacity ratio of the gas, T [K] is the temperature of gas in the volume V [$m^3$], and p [Pa] is absolute pressure in the volume, and $\dot{m}_{in}$ and $\dot{m}_{out}$ [kg/s] are the mass of the gas into and out of the volume V, respectively. Another of the four types of differential equations may be the differential equation of temperature between components of the engine 12:

$$\frac{dT}{dt} = \frac{\tilde{R}T}{c_V pV}(c_p T_{in}\dot{m}_{in} - c_p T\dot{m}_{out} - c_V T(\dot{m}_{in} - \dot{m}_{out})) \tag{14}$$

Here, $c_v$ and $c_p$ [J/(kg K)] are gas specific heat capacities for constant volume and constant pressure, respectively. A further differential equation of the four types of differential equations may be the differential equation of the mass fraction of a gas species, X:

$$\frac{dX}{dt} = \frac{\tilde{R}T}{pV}(\dot{m}_{in}X_{in} - \dot{m}_{out}X) \tag{15}$$

Here, X is the gas species fraction in the volume and $X_{in}$ is the same species mass fraction in the gas flowing into the volume. The last of the four types of differential equations may be the differential equation of a turbocharger speed:

$$\frac{dN}{dt} = \left(\frac{30}{\pi}\right)^2 \frac{1}{I}\frac{W_{turb} - W_{comp}}{N} \tag{16}$$

Here, N [rpm] is the turbo charger rotational speed, $W_{turb}$ [W] is mechanical power of the turbine and $W_{comp}$ is mechanical power absorbed by the compressor. I [kg $m^2$] is the turbocharger momentum of inertia.

The four types of differential equations may represent mass, energy, and matter conservation laws combined with the ideal gas equation. The terms appearing on the right-hand side of each of the four types of differential equations may be defined by the engine components, such as turbine and compressor maps and/or valve characteristics. In one example, the turbine power, $W_{turb}$, appearing in equation (16) may be expressed in terms of turbine mass flow, turbine pressure ratio, and/or turbine inlet temperature, as well as isentropic efficiency which may be modeled empirically (e.g., modeled by fitting to turbine gas data):

$$\dot{W}_{trb} = F_2 c_p T_3\left(1 - \left(\frac{p_3}{p_1}\right)^{\frac{1-\gamma}{\gamma}}\right)\eta\left(\frac{p_3}{p_1}, N\right) \tag{17}$$

The set of four types of differential equations may be expressed using a state-space representation that may group variables into states, x, (e.g., pressures, temperatures, concentrations, turbo speed), inputs, u, (both actuators positions and disturbances), and outputs measured by physical sensors, y:

$$\frac{dx(t)}{dt} = f(t, x(t)) \tag{18}$$

$$y(t) = g(t, x(t)) \tag{19}$$

Here, the function $f$ defines the right-hand sides of the differential equations and the function g defines the model values for physical sensors. These functions are time dependent, possibly through the vector inputs of u.

The above differential equations may be stiff and, generally, may be solved with variable step ODE solvers. Such variable step ODE solvers may require large quantities of processing power and/or memory. For the purpose of real-time simulations and/or estimates (e.g., during operation of the engine 12) on an ECM/ECU or other on-line portion of the controller 18, the equations may be modified to project a state vector to a lower dimension (e.g., lower order), such as do DAE based models.

The air-path state estimator 26 may solve an optimization problem on a time window (finite or infinite) to minimize the norm of prediction errors. In some cases, the optimization problem may take the following form:

$$\min_{x(t)} \sum_{\tau_k=0}^{t} \|y_{sens}(\tau_k) - g(\tau_k, x(\tau_k))\|_R^2 \tag{20}$$

$$subj.to \frac{dx}{d\tau} = q(\tau, x(\tau)),\ \tau \in [0, t]$$

Where, at the current time (at time t), the air path state estimator 26 may minimizes certain quadratic norm $\|\bullet\|_R^2$ of the model prediction errors (e.g., the norm of differences between the sensed values $y_{sens}(\tau_k)$ and the model predicted values $g(\tau_k,u(\tau_k))$. The prediction errors at certain discrete time instants $\tau_k$ are considered in the optimization. This optimization respects that the air-path estimated state trajectory must satisfy the model differential equations. Here, the functions q,g may correspond to the second model represented and simulated in the on-line portion of the controller. The result of the optimization problem may define the current intake and/or exhaust manifold conditions, which may be needed for calculations by the NOx concentration module 27, other downstream virtual sensors, and/or downstream diagnostics. An output 38 of may proceed from concentration module 27.

Figure 3:
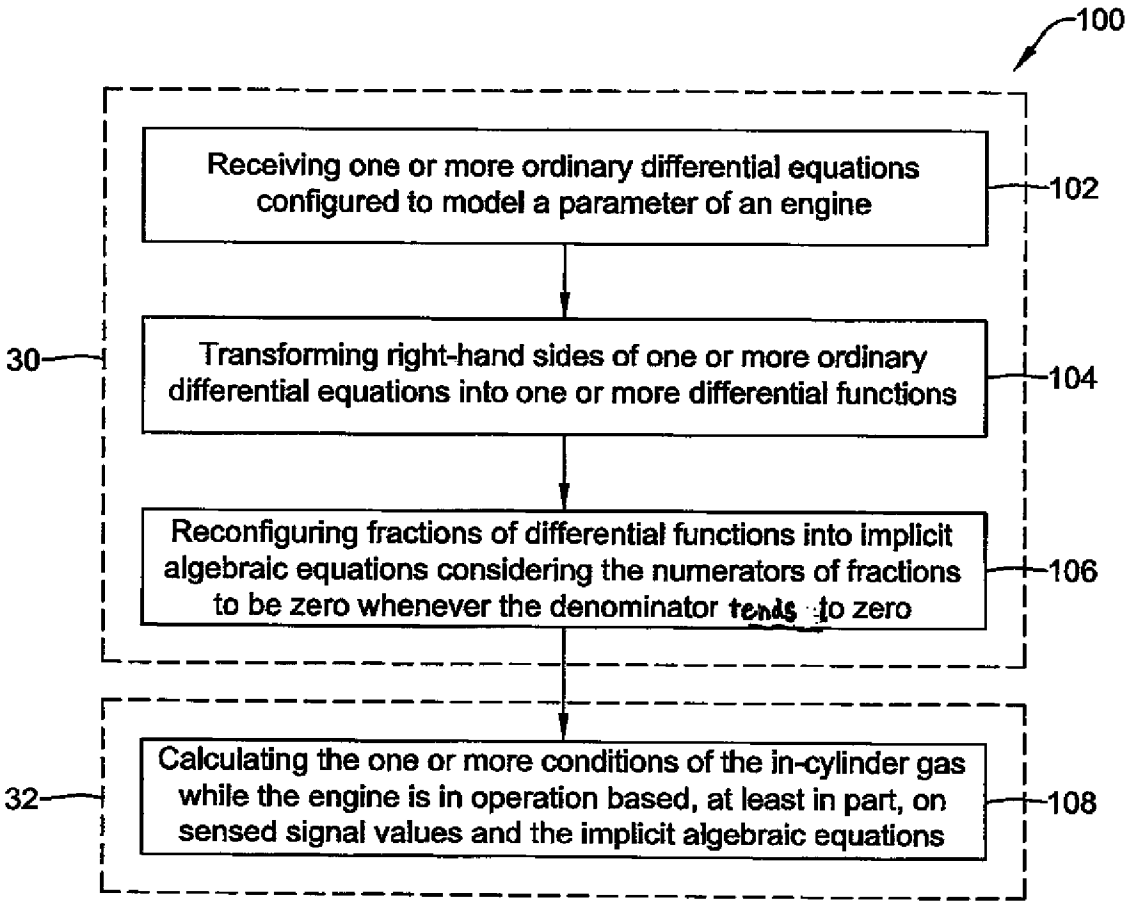
FIG. 3 is a diagram of an illustrative example approach of configuring and using a calibrated model on a controller or diagnostic system having an on-line portion and an off-line portion.

The air-path state estimator 26 (e.g., a module in the on-line portion 32 of the controller 18 that may include a mean-value air path model or other model) may be used in one or more engine monitoring and/or control approaches. In one example, the air path state estimator 26 may be used in an approach 100, as shown in FIG. 3, for determining conditions of an engine in operation based, at least in part, on signal values of a variable sensed by one or more sensors in communication with the engine 12. At box 102 of the approach 100, one or more differential equations and/or functions (e.g., ordinary differential equations and/or other differential equations) configured to model a parameter of an engine may be received and/or identified (e.g., received and/or identified at the off-line portion 30 of the controller 18). Example engine parameters that may be modeled include, but are not limited to, an intake manifold temperature of the engine 12, an intake manifold pressure of the engine 12, an intake manifold gas concentrations of the engine 12 (e.g., $N_2$, $O_2$, CO2, $H_2O$, and so forth), an in-cylinder charge mass, an in-cylinder charge temperature, an in-cylinder charge gas composition, an in-cylinder residual mass temperature, an in-cylinder residual mass gas composition, a pressure between components of an engine, a temperature between components of an engine, mass fractions of one or more gasses in an engine, a speed of a turbocharger of an engine. Values of these engine parameters that may be modeled may be outputted from the air-path state estimator 26.

At box 104 in the approach 100 shown in FIG. 3, right hand sides of the received ODEs may be transformed (e.g., converted) into one or more differential functions, wherein the one or more ODEs may at least partially form a first model of the engine 12 having a first order and the one or more differential functions may be configured to at least partially form a second model of the engine having an order lower than the first order. In some cases, the first model and the second model may result in similar outputs when similar inputs are received, but with the second model requiring less processing time and/or power to produce the output. The transformed differential functions may include one or more algebraic differential equations and differentiable functions (e.g., fractions of differential functions and/or one or more other types of functions). In one example, the right-hand sides of the received ordinary differential equations may be transformed or converted into algebraic differential equations and one or more of rational polynomial functions, fractions of polynomials, differential functions, and rational differentiable functions. Other transformations and/or conversions may be utilized as desired.

Then, at box 106 in the approach 100 of FIG. 3, differential functions having a fractional form may be reconfigured into implicit algebraic equations. This step may be performed when the denominators tend to zero and/or at other times. In one example, reconfiguring the differential functions having a fractional form into an implicit algebraic equation may include multiplying by the denominators of the differential functions to ensure the equations do not necessarily require division by zero, as shown with respect to equation (9). Further, in some cases, the numerators may be made equal to zero, as shown above in equation (10). Such configuring of the differential functions may result in a model of a system having DAEs and differentiable functions, which may be equivalent to assuming all or substantially fast dynamics of the functions may be in steady state. Once the model of a system having DAEs and differentiable functions having a lower order than the original ODE model has been developed, the lower order model may be considered calibrated for the engine 12 and sent from the off-line portion 30 of the controller 18 to the on-line portion 32 of the controller 18 to determine parameter states of the engine based, at least in part, on the developed model.

Then, the air-path state estimator 26 may calculate, at box 108, one or more parameter values (e.g., conditions) of one or more in-cylinder gases while the engine 12 is in operation (e.g., current conditions of the engine). The calculated one or more parameter values of the in-cylinder gas may be based, at least in part, on signal values for sensed variables received from sensors 14 and the differential and algebraic equations (e.g., the differential and algebraic equations constituting the second model of the engine). As discussed, the calculated one or more parameter values of the in-cylinder gas may be used as boundary conditions, initial in-cylinder gas conditions, engine air-path estimates, and/or other inputs for downstream virtual sensor modules and/or control algorithms. Alternatively, or in addition, the outputs of the air-path state estimator 26 may be displayed on a display (e.g., a display in communication with the controller 18) and/or used in an on-board diagnostics system (e.g., an on-board diagnostics system configured to monitor operation of the engine 12).

Figure 4:
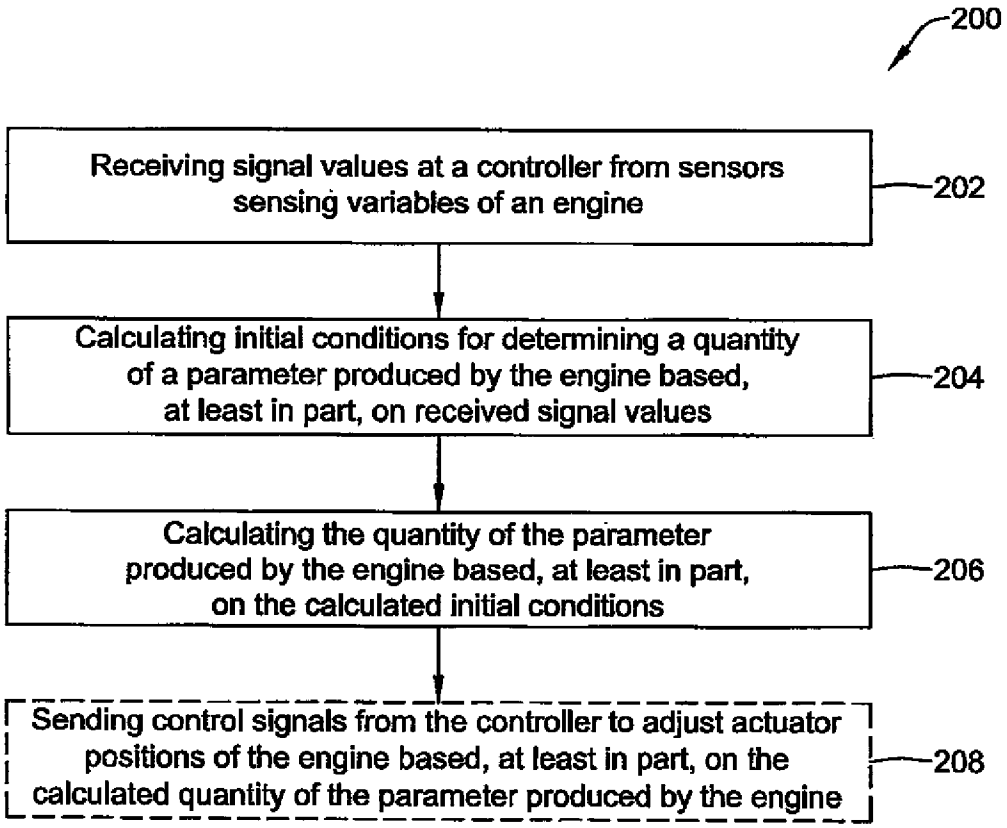
FIG. 4 is a diagram of an illustrative example approach of using a controller with a calibrated algorithm.

In FIG. 4, one or more modules (e.g., the air-path state estimator 26 and a virtual sensor (e.g., the NOx concentration module 27)) in the on-line portion 32 of the controller 18 may be utilized in an approach 200 of monitoring a quantity of a parameter (e.g., NOx, and so on) produced by engine 12. The approach 200 may include receiving, at box 202, signal values relating to the engine 12 (e.g., an operating engine) at the controller 18 from one or more sensors 14 sensing variables of the engine 12. At box 204, one or more parameter values for the in-cylinder gas may be determined (e.g., calculated) with a first module (e.g., the air-path state estimator 26 or other module) in the controller 18. In one example, the one or more determined parameter values of the in-cylinder gas may be determined based, at least in part, on the model developed according to approach 100 of FIG. 3 and/or may be determined based, at least in part, on one or more other models. Illustratively, the determined parameter values of the in-cylinder gas may be utilized as initial conditions in a downstream module for determining a quantity of a parameter produced by the engine. Alternatively, or in addition, the determined parameter values of the in-cylinder gas may be used for diagnostics and/or monitoring of the engine 12. In some cases, the produced parameter values of the in-cylinder gas may be calculated in real-time (e.g., as the engine is operating) with the on-line portion 32 of the controller 18. Example in-cylinder gas parameters (e.g., engine parameters) for which values may be estimated by the air-path state estimator 26 may include, but are not limited to, an intake manifold temperature of the engine 12, an intake manifold pressure of the engine 12, intake manifold gas concentrations of the engine 12 (e.g., $N_2$, $O_2$, CO2, $H_2O$, and so on), in-cylinder charge mass, in-cylinder charge temperature, in-cylinder charge gas concentrations, in-cylinder residual mass temperature, in-cylinder residual mass gas concentrations, and so forth.

Based, at least in part, on the calculated parameter values of the in-cylinder gas, a second module (e.g., a downstream module, such as a NOx concentration module 27) in the on-line portion 32 of the controller 18 may determine (e.g., calculate) a value or quantity of a parameter produced by the engine 12, as shown at box 206 in FIG. 4. In some cases, the value or quantity of the parameter produced by the engine (e.g., NOx concentration in exhaust gas of the engine) may be calculated in real-time (e.g., as the engine is operating) with the online portion 32 of the controller 18.

Once the value or quantity of the parameter produced by the engine 12 is determined, the value or quantity of the parameter produced by the engine may be used as an input to a display (e.g., in an on-board diagnostics system or other diagnostics system), as an input to a further virtual sensor or module, and/or as an input to a control algorithm. In one optional example, as shown by dashed box 208 of FIG. 4, a control signal may be sent from the controller 18 to the engine 12 to adjust one or more actuator positions of the engine based, at least in part, on the quantity or value of the parameter produced by the engine 12. The control signal sent from the controller 18 to the engine 12, if any, may be configured and/or timed to adjust actuators 16 of the engine 12 in real-time and result in adjusting the value of the parameter produced by the engine 12 (e.g., the NOx concentration in exhaust gas of the engine 12) while the engine 12 may be operating.

In one case, a control signal may be sent from the controller 18 to the engine 12 to an on-board diagnostics system in two-way communication with the controller 18 and configured to monitor operation of the engine 12. In one example, the control signal(s) sent to the on-board diagnostics system may affect what is displayed on a display of the on-board diagnostics system, instruct the on-board diagnostics system to create and/or log a report, instruct the on-board diagnostics system to sound and/or display an alarm, and/or may communicate one or more other instruction to the on-board diagnostics system.

A recap may be provided in the following. An engine system may incorporate an engine, one or more sensors, and a controller. Each of the one or more sensors may be configured to sense one or more parameters related to operation of the engine. The controller may incorporate one or more virtual sensors configured to estimate one or more air-path state parameters related to the operation of the engine based, at least in part, on values of one or more parameters sensed by one or more of the sensors.

The one or more virtual sensors may incorporate an air-path state estimator configured to estimate one or more of an intake manifold temperature of the engine, an intake manifold pressure of the engine, an exhaust manifold pressure of the engine, a fuel per stroke of the engine, intake manifold gas composition of the engine, an in-cylinder charge mass, an in-cylinder charge temperature, an in-cylinder charge pressure, an in-cylinder charge composition, a residual mass temperature, and a residual mass composition. The air-path state estimator may estimate one or more other parameters related to an engine.

The one or more virtual sensors of the controller may incorporate an air-path state estimator. Additionally, or alternatively, the one or more virtual sensors of the controller may incorporate a NOx concentration module.

The air path estimator may determine initial conditions for the NOx concentration module.

The controller of the engine system may incorporate a plurality of control units.

The controller of the engine system may incorporate an off-line portion and an on-line portion. The on-line portion may be configured to incorporate an air-path state estimator module of a virtual sensor. The air-path state estimator module may be configured to estimate the one or more air-path state parameters related to the operation of the engine. The off-line portion may be configured to determine one or more differential equations for an air-path state estimator module.

The controller may incorporate a plurality of control units. A first control unit of the controller may incorporate the off-line portion of the controller. A second control unit of the controller may incorporate the on-line portion and may be in communication with the first control unit.

The off-line portion of the controller may be configured to transform right-hand sides of one or more ordinary differential equations. The off-line portion may be configured to transform the right-hand sides of the ordinary differential equations into one or more differentiable right-hand side functions and one or more fractions of differentiable functions which can be represented by algebraic equations with differentiable functions whenever the denominator is close to zero.

The engine of the engine system may incorporate one or more turbochargers. Based on values of the parameters sensed by the one or more sensors, the air-path state estimator may solve one or more of a differential equation of pressure between components in a volume of the engine, a differential equation of temperature between components of the engine, and a differential equation of a turbocharger speed of one or more turbochargers.

An approach of monitoring a quantity of a parameter produced by an engine with one or more modules in a controller that is in communication with the engine. The approach may incorporate receiving signal values at a controller from one or more sensors sensing variables of an engine. A first module of the controller may be configured to calculate one or more initial conditions of the in-cylinder gas for determining a quantity of a parameter produced by the engine based, at least in part, on one or more received signal values. The controller may incorporate a second module configured to calculate the quantity of the parameter produced by the engine based, at least in part, on the calculated initial conditions of the in-cylinder gas.

The approach of monitoring may further incorporate sending control signals from the controller to adjust actuator positions of the engine. The control signals may be configured to adjust actuator positions of the engine based, at least in part on the calculated quantity of the parameter produced by the engine.

The approach of monitoring may further incorporate sending control signals from the controller to an on-board diagnostics system configured to monitor operation of the engine.

The first module used in the approach of monitoring may incorporate an air-path state estimator. The air-path state estimator may be configured to determine one or more initial conditions for determining the quantity of the parameter produced by the engine in real-time and on-line during operation of the engine.

In the approach of monitoring, the one or more initial conditions for determining the quantity of the parameter produced by the engine may incorporate one or more of an intake manifold pressure of the engine, an intake manifold temperature of the engine, an exhaust manifold pressure of the engine, a fuel per stroke of the engine, one or more gas compositions in the intake manifold of the engine, in-cylinder charge mass, in-cylinder charge temperature, in-cylinder charge pressure, in-cylinder charge composition, residual mass temperature, and residual mass composition.

In the approach of monitoring, one or more differential equations in the first module may be used to calculate the one or more initial conditions. The one or more initial conditions may be for determining the quantity of the parameter produced by the engine.

The one or more differential equations may incorporate a differential equation modeling pressure between components of an engine, a differential equation modeling temperature between components of an engine, a differential equation modeling a mass fraction of one or more gasses in an engine, and/or a differential equation modeling a speed of a turbocharger of an engine.

The one or more differential equations in the first module may be configured in an off-line portion of the controller. The one or more differential equations may be configured by converting ordinary differential equations configured to model engine parameter values to a same or lower number of differential equations including one or more algebraic equations.

An approach may be used for determining conditions of an engine in operation based, at least in part, on signal values sensed by one or more sensors in communication with the engine. The approach may incorporate receiving one or more ordinary differential equations configured to model a parameter of an engine. Right hand sides of the one or more differential equations may be transformed into one or more functions represented as fractions of differentiable functions. The one or more ordinary differential equations may be configured to at least partially form a first model of an engine having a first order and the one or more differential functions may be configured to at least partially form a second model of the engine having an order lower than the first order. Fractions of the differentiable functions of the second model may be reconfigured into implicit algebraic equations considering the numerators of fractions to be zero whenever the denominator becomes close to zero. The approach of determining conditions of an engine may further incorporate calculating the one or more conditions of in-cylinder gas while the engine is in operation based, at least in part, on sensed signal values and the second model of the engine having an order lower than the first order.

The approach for determining conditions of the engine may incorporate using one more of the calculated initial conditions of the in-cylinder gas to determine parameter values for a parameter of the operating engine.

The approach for determining conditions of the engine may incorporate adjusting positions of the actuators of the engine. In one example, the positions of the actuators of the engine may be adjusted with control signals from the control response to the determine parameter values for the parameter of the operating engine.

Any publication or patent document noted herein is hereby incorporated by reference to the same extent as if each individual publication or patent document was specifically and individually indicated to be incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to incorporate all such variations and modifications.

What is claimed is:

1. An engine system comprising:

an engine;

one or more sensors each configured to sense one or more parameters related to operation of the engine; and a controller in communication with the engine and the one or more sensors, the controller comprises a first virtual sensor and a second virtual sensor; and wherein:

the first virtual sensor is configured such that during operation of the engine the first virtual sensor determines one or more initial conditions for the second virtual sensor based at least in part on values of the one or more parameters sensed by the one or more sensors by solving a differential algebraic equation to determine the one or more initial conditions;

the second virtual sensor is configured such that during operation of the engine, the second virtual sensor determines values for one or more output parameters of the engine; and the controller is configured to send control signals to the engine to control operation of the engine, the controller is configured to determine the control signals based, at least in part, on the values for one or more output parameters of the engine determined by the second virtual sensor.

2. The engine system of claim 1, wherein the second virtual sensor solves a differential algebraic equation to determine the values for one or more output parameters of the engine.

3. The engine system of claim 1, wherein the first virtual sensor incorporates an air-path state estimator configured to estimate one or more of an intake manifold temperature of the engine, intake manifold pressure of the engine, exhaust manifold pressure of the engine, an amount of fuel per stroke of the engine, intake manifold gas composition of the engine, in-cylinder charge mass, in-cylinder charge temperature, in-cylinder charge pressure, in-cylinder charge composition, residual mass temperature, and residual mass composition.

4. The engine system of claim 1, wherein the second virtual sensor incorporates a NOx concentration module.

5. The engine system of claim 4, wherein the second virtual sensor solves a differential algebraic equation obtained from a physics based model of the engine to determine an output of the NOx concentration module.

6. The engine system of claim 1, wherein:

the first virtual sensor incorporates an air-path state estimator; and the second virtual sensor incorporates a NOx concentration module that solves a differential algebraic equation obtained from a physics based model of the engine to determine an output of the NOx concentration module.

7. The engine system of claim 1, wherein the controller comprises:

an off-line portion; and an on-line portion configured to incorporate the first virtual sensor and the second virtual sensor; and wherein the off-line portion is configured to determine one or more differential equations for one of the first virtual sensor and the second virtual sensor.

8. The engine system of claim 7, wherein the controller comprises a plurality of control units and a first control unit of the plurality of control units incorporates the off-line portion and a second control unit of the plurality of control units that incorporates the on-line portion and is in communication with the first control unit.

9. The engine system of claim 7, wherein:

the first virtual sensor and the second virtual sensor are configured to estimate one or more parameters related to the operation of the engine; and the off-line portion of the controller is configured to derive an ordinary differential equation (ODE) model of the one or more parameters estimated by one or both of the first virtual sensor and the second virtual sensor into a differential algebraic equation (DAE) model of the one or more parameters estimated by one or both of the first virtual sensor and the second virtual sensor.

10. The engine system of claim 1, further comprising:

one or more turbochargers; and wherein the first virtual sensor solves one or more of the following:

a differential equation of pressure between components in a volume of the engine;

a differential equation of temperature between components of the engine;

a differential equation of a mass fraction of a gas species in the engine; and a differential equation of a turbocharger speed of one or more turbochargers.

11. A method of controlling operation of an engine system, the method comprising:

receiving values of one or more sensed parameters from a physical sensor, the one or more sensed parameters are related to an operation of an engine;

using a first differential algebraic equation to calculate one or more initial conditions of an in-cylinder gas based, at least in part, on the values of one or more sensed parameters received from the physical sensor;

using a second differential algebraic equation to calculate one or more values of a parameter output from the engine based, at least in part on the one or more initial conditions of the in-cylinder gas;

determining one or more control signals to control operation of the engine, the one or more control signals are determined based, at least in part on, the one or more values of a parameter output from the engine that are calculated; and sending the one or more control signals to the engine.

12. The method of claim 11, wherein the sending the one or more control signals includes sending control signals to an on-board diagnostics system configured to monitor operation of the engine.

13. The method of claim 11, wherein the one or more initial conditions of the in-cylinder gas incorporate one or more of an intake manifold pressure of the engine, an intake manifold temperature of the engine, an exhaust manifold pressure of the engine, an amount of fuel per stroke of the engine, one or more gas compositions in an intake manifold of the engine, in-cylinder charge mass, in-cylinder charge temperature, in-cylinder charge pressure, in-cylinder charge compositions, residual mass temperatures, and residual mass compositions.

14. The method of claim 11, wherein the first differential algebraic equation and the second differential algebraic equation are configured in an off-line portion of a controller of the engine system.

15. The method of claim 14, wherein in the off-line portion of the controller:

the first differential algebraic equation is determined by converting a first ordinary differential equation configured to model engine parameter values to a same or lower number of differential equations including the first differential algebraic equation; and the second differential algebraic equation is determined by converting a second ordinary differential equation configured to model engine parameter values to a same or lower number of differential equations including the second differential algebraic equation.

16. The method of claim 11, wherein using the first differential algebraic equation to calculate one or more initial conditions of an in-cylinder gas includes solving one or more of the following:

a differential equation of pressure between components in a volume of the engine;

a differential equation of temperature between components of the engine;

a differential equation of a mass fraction of a gas species in the engine; and a differential equation of a turbocharger speed of one or more turbochargers of the engine system.

* * * * *